US011891794B2

(12) United States Patent
Mercolini

(10) Patent No.: US 11,891,794 B2
(45) Date of Patent: Feb. 6, 2024

(54) SYSTEM FOR THE TRANSMISSION OF LIQUIDS IN A ROTATABLE BUILDING

(71) Applicant: LM TECH S.R.L., Milan (IT)

(72) Inventor: Lorenzo Mercolini, Milan (IT)

(73) Assignee: LM TECH S.R.L., Milan (IT)

( * ) Notice: Subject to any disclaimer, the term of this patent is extended or adjusted under 35 U.S.C. 154(b) by 425 days.

(21) Appl. No.: 17/281,307

(22) PCT Filed: Oct. 1, 2018

(86) PCT No.: PCT/IB2018/057609
§ 371 (c)(1),
(2) Date: Mar. 30, 2021

(87) PCT Pub. No.: WO2020/070537
PCT Pub. Date: Apr. 9, 2020

(65) Prior Publication Data

US 2021/0404171 A1 Dec. 30, 2021

(51) Int. Cl.
*E04B 1/34* (2006.01)
*E04B 1/346* (2006.01)

(52) U.S. Cl.
CPC ..... *E04B 1/3465* (2013.01)

(58) Field of Classification Search
CPC ..... E04B 1/3465; E04B 1/346; E04B 1/343
USPC ..... 52/65; 137/356, 357
See application file for complete search history.

(56) References Cited

U.S. PATENT DOCUMENTS

| | | | |
|---|---|---|---|
| 407,877 | A | 7/1889 | Rowe |
| 2,563,531 | A | 8/1951 | Kirkman |
| 2,927,599 | A | 3/1960 | Stetson |
| 3,905,166 | A | 9/1975 | Kaiser |
| 6,742,308 | B1 | 6/2004 | Johnstone, III et al. |
| 7,107,725 | B2 | 9/2006 | Johnstone, III et al. |

(Continued)

FOREIGN PATENT DOCUMENTS

| | | | |
|---|---|---|---|
| DE | 102007047259 | A1 | 4/2009 |
| FR | 1242847 | A | 10/1960 |

(Continued)

OTHER PUBLICATIONS

International Search Report and Written Opinion for International Patent Application No. PCT/IB2018/057609, dated Jul. 11, 2019, 14 pages.

*Primary Examiner* — Kelsey E Cary
(74) *Attorney, Agent, or Firm* — Armstrong Teasdale LLP

(57) ABSTRACT

A system for transmitting liquids between a stationary core and a rotatable story of a building includes annular buffer ducts, each having a lower duct portion and an upper duct portion in liquid communication with and slidingly engaging the lower duct portion via an interface. The lower and upper duct portions are fixed to the stationary core and rotatable story respectively, or vice versa, so that the lower and upper duct portions are rotatable relative to each other. The buffer ducts internally define a transmission chamber into which liquid enters through inlet ports formed by the upper duct portion, and from which liquid exits through outlet ports formed by the lower duct portion. The buffer ducts also include a supply duct connected to clean water pumps for increasing the water pressure in clean water accumulation tanks to a desired value. The transmission chamber is at atmospheric pressure.

14 Claims, 13 Drawing Sheets

(56) References Cited

U.S. PATENT DOCUMENTS

| | | | | |
|---|---|---|---|---|
| 8,032,256 | B1 * | 10/2011 | Wolf | E03F 5/22 417/120 |
| 2002/0045383 | A1 * | 4/2002 | Johnstone, III | E04B 1/3465 439/534 |
| 2006/0248808 | A1 | 11/2006 | Franco et al. | |
| 2009/0205264 | A1 | 2/2009 | Fisher | |

FOREIGN PATENT DOCUMENTS

| | | | |
|---|---|---|---|
| FR | 1420219 | A | 12/1965 |
| FR | 2063633 | A5 | 7/1971 |
| WO | 2007148192 | A2 | 12/2007 |

* cited by examiner

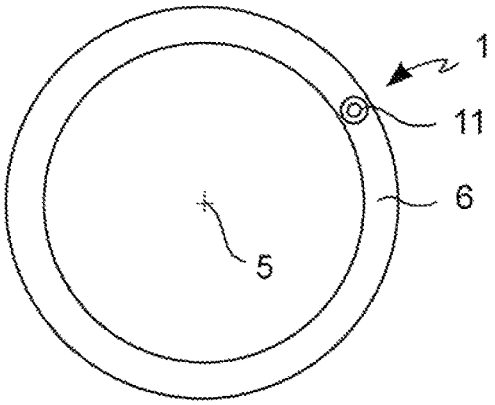
FIG. 1
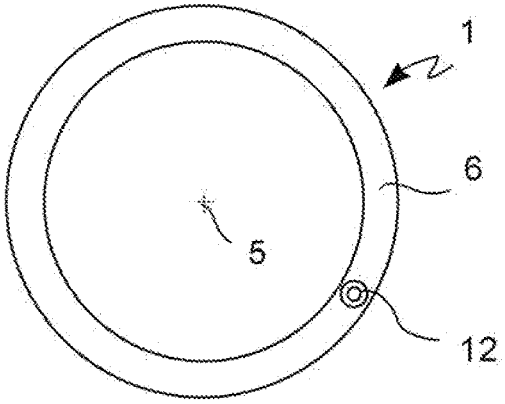
FIG. 2
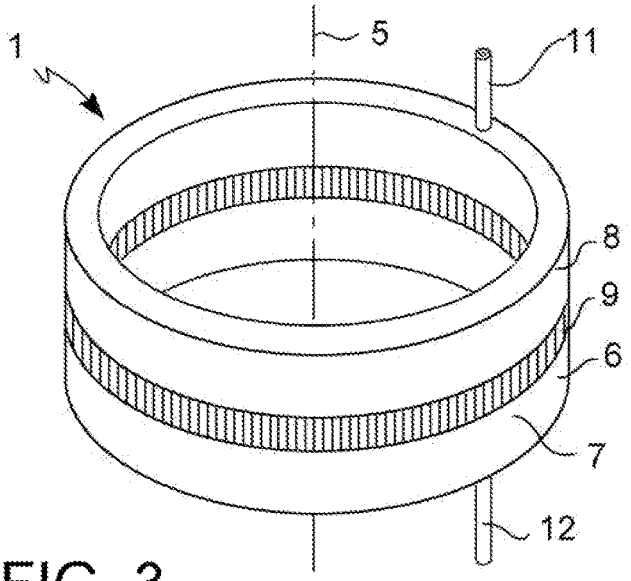
FIG. 3
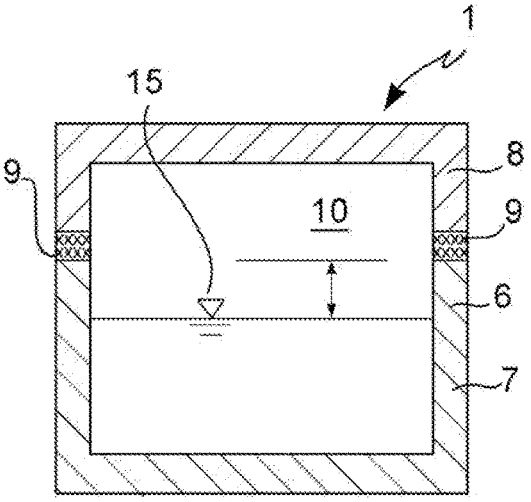
FIG. 4A
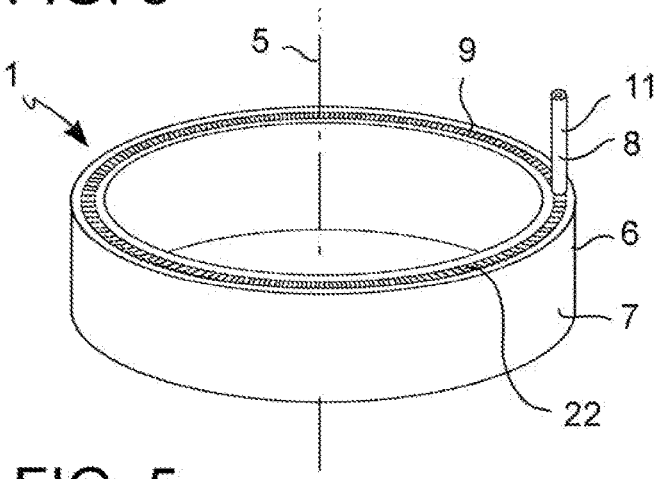
FIG. 5
FIG. 7
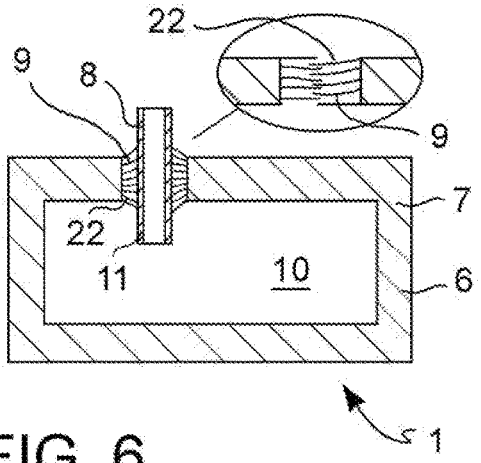
FIG. 6

SYSTEM FOR THE TRANSMISSION OF LIQUIDS IN A ROTATABLE BUILDING

CROSS-REFERENCE TO RELATED APPLICATIONS

This application is a National Phase Application of PCT International Application No. PCT/IB2018/057609, having an International Filing Date of Oct. 1, 2018, which is hereby incorporated by reference in its entirety.

FIELD OF THE INVENTION

The present invention relates to a system for the transmission of liquids, e.g. clean water and wastewater, between a stationary core and a rotatable story of a building in which said rotatable story is formed circumferentially around and rotatable with respect to said stationary core. In the remainder of the present document the term "liquid" is to be construed as any liquid or semi-liquid substance requiring said transmission, except in the terms "liquid seal", "sealing liquid" and "flushing liquid", whose meanings will be made clear in the description.

BACKGROUND OF THE INVENTION

The feature of an apartment or hotel suite of providing a desirable view determines its salability and economic value. In addition, the ability to change external appearance and shape can significantly increase the appeal of a residential and/or commercial (e.g. hotel or conference) building for potential clients and/or investors. Moreover, the ability to reposition individual stories of a multistory building in order to purposely change their exposure (e.g. to sunlight or shadow), or their access to external infrastructure can be required for the purpose of energy saving or for meeting specific requirements in civil, industrial or military applications.

Known examples of rotatable buildings are observation towers and restaurants that are frequently single story, or top-floor only, rotatable installations which provide users with changeable views. Examples of such structures are shown e.g. in U.S. Pat. Nos. 3,905,166, 6,742,308, and 841468.

Further examples of rotatable buildings are multistory apartment buildings or hotels with a selective 360° viewing capability and an individual or independent rotation of single stories. Examples of such buildings have been described e.g. in US2009/205264A1 and US2006/0248808A1.

The known multistory rotatable buildings have in common certain drawbacks and critical aspects contributing to high erection and operation costs, and precluding a fully reliable operation and acceptance thereof by investors. One of these critical aspects is to ensure the distribution and transmission of services (electricity, data, clean water, wastewater, etc.) between the stationary support structure and the rotatable stories. Another critical aspect is to ensure the structural reliability and maintenance of the rotatable support and rotating capability of the stories over decades of service life of the building.

While there are known ways to ensure a reliable transmission of electricity and other signals between elements in motion relative to each other (essentially via the technologies present in trains, telescopes, steering wheels, etc.), and while a co-pending patent application by the author describes an efficient way to ensure the aforementioned structural reliability, the present invention describes a reliable and efficient way to ensure the distribution and transmission of clean water and wastewater between elements in motion relative to each other.

Previous descriptions of such systems for transmitting liquids mention sealing elements at the interface between the fixed and rotatable portions, without however actually disclosing the structure and configuration of the sealing elements, or by defining the sealing elements as being fluid tight and fluid pressure resistant gaskets. Generally, the author of the present invention believes that the failure to provide specific details about the nature of the sealing element is a major shortcoming because an appropriate sealing element is decisive for the correct functioning of liquid transmission in the case of this very particular application. Specifically, gaskets are not adapted for the sealing of liquid transmission systems in the case of multiple stories independently cantilevered off a core of e.g. 20 meters in diameter, for a number of reasons. Firstly, given the significant length of the interface (more than 60 metres at the perimeter of the core), fluid tight gaskets would generate excessive friction resulting in unacceptably high energy consumption for imparting the rotation of the story with respect to the core. Secondly, very long gaskets may generate stick-slip phenomena upon initial floor motion, resulting in the building's occupants uncomfortably feeling the change of speed. Thirdly, fluid tight gaskets would be very complicated to maintain because they could not be replaced as a whole due to the stories' profile. They would need to be stretched out to approximately twice their diameter, rolled vertically at the exterior of the building and fitted into place at the right height, none of which is a feasible option. In the event of failure, damaged gasket sections would hence need to be removed and new gasket sections would need to be welded onto the residual gasket, thus making the latter of unequal quality throughout its circumference, ultimately curtailing its sealing ability in the long run. Moreover, such gasket repairs would result in unacceptably long downtimes, during which the building's occupants would not benefit from continued liquid transmission.

WO2007/148192 describes a toroidal pipe fixed to the stationary core and having a partial opening all the way around. This precludes the possibility of having a much more efficient vertically oriented stationary tube inserted in and cooperating with a self-sealing brush of the type that will be described in connection with an embodiment of a clean water transmission system of the present invention.

WO2007/148192 also describes a pipe fixed to the rotatable floor and sealingly connected to the opening in the toroidal stationary pipe. This precludes the possibility of arranging the seal or interface region distant from the point where liquids are exchanged between the stationary part and the rotatable part of the building. The closeness and direct contact of the sealing gasket and the transmitted liquid can corrode the gasket and jeopardize the gasket's water-tightness.

As will be apparent from the following description of the present invention, it is much more efficient for the seal or interface to be distant from the point of exchange of the liquids and from the exchanged liquid, preferably at a higher vertical position than the liquid level, thus significantly reducing the risk of leakage—which is a key feature of the present invention. WO2007/148192 indicates in the figures, e.g. FIG. 13, that the sealing element is a gasket, with all the aforementioned drawbacks of a gasket.

WO2007/148192 also describes fixed and moving pipes sliding into one another, which may prove a very fragile setup, especially under extreme conditions such as earthquakes. As will be apparent from the following description of the present invention, the elements in relative motion with respect to each other do not need to be configured in such a way that one of them is inside the other.

WO2007/148192 also describes a solution with a plurality of connection interfaces between the stationary and the rotating building parts, placed at predetermined positions for the exchange of liquids at only those predetermined positions. The floor would thus stop its rotation at positions enabling the connection fittings to connect automatically for the exchange of liquids. Firstly, such automatically triggered connections necessarily require additional energy as well as high levels of maintenance. Secondly, if the floor's rotation unexpectedly stops, e.g. due to a failure of the general rotation imparting device, e.g. electric motors, the connection fittings may not be in correspondence with one another, thus preventing any liquid transmission. Such a design would likely not meet fire safety requirements, not to mention the comfort of the occupants.

WO2007/148192 finally describes a system comprising flexible pipes connected to the core whose "exterior ends" (e.g. their nozzles) are moved by motors along a circumferential rail in order to bring them in correspondence with a connection point through which liquids can be exchanged. When a flexible pipe becomes completely stretched due to the rotation of the connection point, it disconnects from the rotating floor while other such flexible pipes connected to the same rotating floor ensure the continued ability to exchange liquids. These constantly moving, connecting and disconnecting flexible pipe "exterior ends" require additional energy as well as high levels of maintenance, thus making them energetically inefficient and prone to failure. Furthermore, such high-precision mechanisms require an impeccable functioning of both the hardware and the underlying software because any failure, albeit momentary, may potentially result in leakages, spills or floods of any type of liquid (e.g. wastewater).

U.S. Pat. No. 7,107,725B2 describes a swivel joint apparatus for supplying utilities (gas, water) to a rotating building rotatable about a central axis. The described clean water transmission system necessarily requires that the water be constantly under pressure, which puts undesired strain on the sealing elements, as described above. The first embodiment of U.S. Pat. No. 7,107,725B2, illustrated in FIGS. 1 to 8, describes horizontal exchanges of liquids via a plurality of chambers, while the second embodiment, illustrated in FIGS. 10 to 13 of U.S. Pat. No. 7,107,725B2, describes vertical exchanges of liquids via a plurality of chambers of a broadly similar concept to that of the first embodiment. While the second embodiment seems more efficient because it reduces the risk of the liquids mixing following a failure of the sealing element, both embodiments require gaskets for sealing the chambers, which is an inefficient solution for the previously stated reasons. In addition, U.S. Pat. No. 7,107,725B2 requires sensor chambers between each pair of adjacent liquid transmission chambers to detect possible leakages. The present invention describes a usage of sensors to prevent any leakage instead of detecting the leakage once it has occurred, which is a more rational and efficient approach.

U.S. Pat. No. 7,107,725B2 describes a system wherein clean water and wastewater are transmitted very close to each other, possibly being only separated by a gasket. The gasket's eventual failure due to friction may lead to unpleasant consequences for the building's clean water consumers. The present invention describes a system wherein the elements transmitting clean water and wastewater are standalone devices, positioned in different locations with respect to the rotatable story, thus eliminating any risk that clean water and wastewater mix.

Scope and General Description of the Invention

The present invention describes significantly more efficient solutions for transmitting liquids from stationary building parts to rotatable building parts, and vice versa, than any solution described in the prior art.

It is an aim of the present invention to focus on prevention rather than on detection of leakage and system failures.

The present invention greatly reduces the risk that transmitted liquids may leak, let alone mix, thereby effectively rendering impossible such occurrence, except under catastrophic circumstances.

It is a key feature of the present invention to provide, between a clean water feeding line at the stationary building part and a clean water receiving line at the rotatable building part, a buffer space in communication with air under atmospheric pressure, thereby maintaining the water at atmospheric pressure during transmission thereof from the stationary building part to the rotatable building part.

Similarly, between a wastewater feeding line at the rotatable building part and a wastewater receiving line at the stationary building part, there is a buffer space in communication with air under atmospheric pressure, thereby maintaining the transmitted wastewater at atmospheric pressure. Both for clean water and wastewater, or for other liquids that may need to be transmitted, the purpose of the buffer space at atmospheric air pressure is to be able to separate, e.g. by vertical distance, the transmitted liquid from an interface region between the stationary and the rotatable building parts, thus obviating the need of leak-tight and pressure resistant gaskets, reducing the frictional resistance, hence reducing the energy required to impart the rotation, and significantly reducing the risk of leakage.

With respect to clean water, some prior art solutions could only work if the water was kept constantly under pressure, although they did not state this requirement explicitly. The atmospheric air pressure buffer removes this constraint, thereby significantly reducing the risk of leakage as stated above. With respect to wastewater, the author of the present invention is not aware of any prior art providing a reliable and efficient way to evacuate the so-called grey and black wastewaters—which is, instead, a further aim of the present invention.

These and other aspects and advantages of the present invention shall be made apparent from the accompanying figures and the description thereof, which illustrate embodiments of the invention and, together with the general description of the invention given above, as well as the detailed description of the embodiments given below, serve to explain the principles of the present invention.

BRIEF DESCRIPTION OF THE FIGURES

In the accompanying figures, which show exemplary non-limiting embodiments of the invention:

FIG. 1 is a view from above of a buffer duct of a liquid transmission system of an embodiment of the invention;

FIG. 2 is a view from below of a buffer duct of a liquid transmission system of an embodiment of the invention;

FIG. 3 is a perspective view of a buffer duct of a liquid transmission system of an embodiment of the invention;

FIG. 4A is a vertical cross-section view of the buffer duct in FIG. 3, in which the buffer duct has a substantially rectangular shape;

FIG. 5 is a perspective view of a buffer duct of a liquid transmission system of a further embodiment of the invention;

FIG. 6 is a vertical cross-section view of the buffer duct in FIG. 5, showing an interface region between a lower duct portion and an upper duct portion that opens only at a section currently engaged by the upper duct portion (vertical pipe);

FIG. 7 shows a detail of the buffer duct in FIG. 6, in which the interface region between the lower duct portion and the upper duct portion is closed along the section that is not currently engaged by the upper duct portion;

DETAILED DESCRIPTION OF THE INVENTION

Figure 4B:
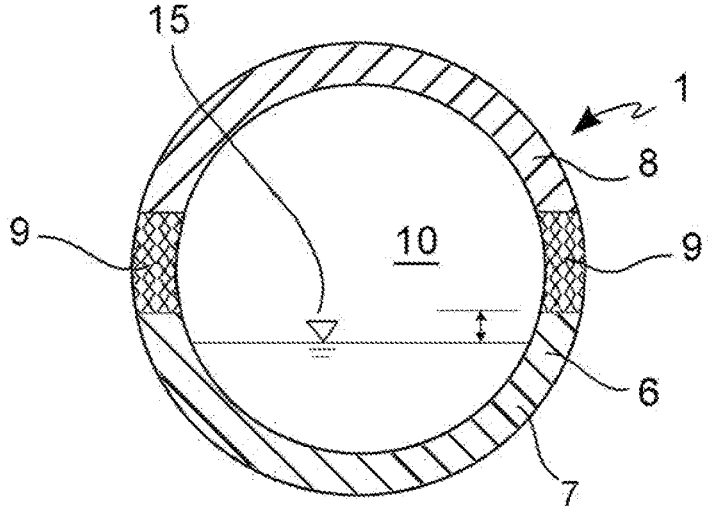
FIGS. 4B and 4C are vertical cross-section views of the buffer duct in FIG. 3, in which the buffer duct has alternative shapes.
Figure 4C:
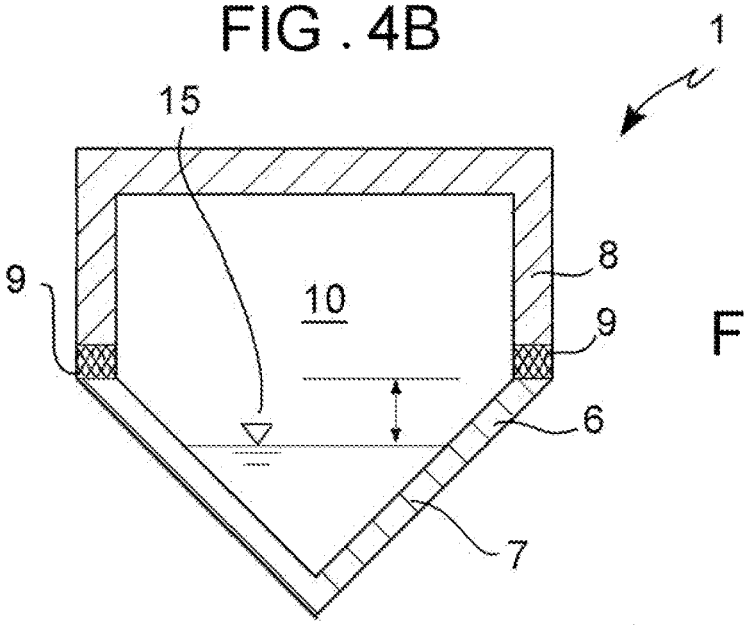
Figure 4D:
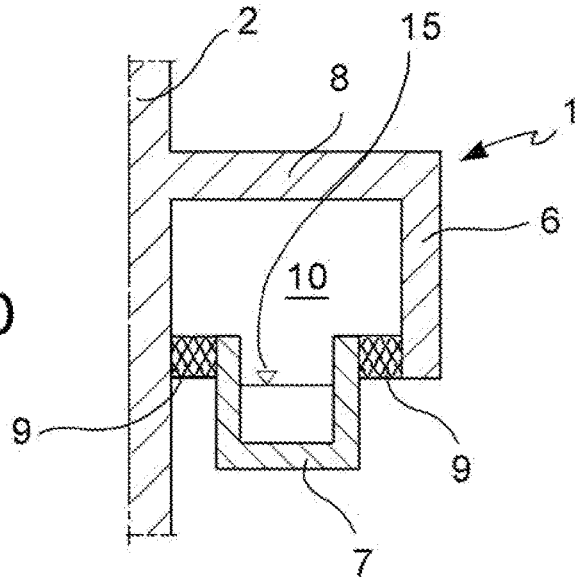
FIG. 4D is a vertical cross-section view of the buffer duct in FIG. 3, in which the upper duct portion is formed as an extension of the core.

With reference to the figures, reference numeral 1 denotes a system for transmitting liquids, e.g. clean water and wastewater, between a stationary core 2 and a rotatable story 3 of a building 4 in which said rotatable story 3 is arranged/extended substantially circumferentially around said stationary core 2 and rotatable with respect to said stationary core 2 about a vertical reference axis 5 that is the longitudinal axis of the core 2 or of a section of the core 2 at which the corresponding story 3 is arranged.

The system 1 comprises a substantially annular buffer duct 6 extending substantially circumferentially around the reference axis 5 of the stationary core 2, preferably externally around the core 2, and having a substantially annular lower duct portion 7 (buffer channel ring) extending along the entire circumferential length of the buffer duct 6, and an upper duct portion 8 (inlet mouth) arranged from above in liquid communication with the lower duct portion 7 and slidingly engaging the lower duct portion 7, preferably in a dust proof manner, in at least one interface 9 extending along the entire circumferential length of the buffer duct 6.

One of the lower duct portion 7 and upper duct portion 8 is fixed to the stationary core 2 and the other one of the lower duct portion 7 and upper duct portion 8 is fixed to the rotatable story 3, so that upon rotation of the story 3 with respect to the core 2 about the reference axis 5, the upper and lower duct portions 8, 7 rotate relative to each other about the reference axis 5.

The buffer duct 6 internally defines a substantially annular transmission chamber 10 into which the liquid enters from above through one or more inlet ports 11 formed in the upper duct portion 8, and from which the liquid exits through one or more outlet ports 12 formed in the lower duct portion 7.

The transmission chamber 10 is at atmospheric pressure, e.g. in communication with ambient air at atmospheric pressure through the interface/s 9 and/or through one or more venting ducts 13. In this manner, the transmitted liquid is buffered in the buffer duct 6 at ambient air pressure with the result that the interface/s 9 do/does not need to be configured as a gasket or as a continuous fluid tight and pressure resistant ring which would otherwise suffer wearing and generate considerable friction resistance and stick-slip phenomena, considering the circumferential length of approximately 60 meters.

In accordance with an embodiment the system 1 comprises a control system 16. The main purpose of the control system 16 is to ensure a continuous supply of clean water, as needed, from the stationary core 2 to the rotatable story 3 and the evacuation of wastewater from the rotatable story 3 to the stationary core 2.

Said control system 16 may be connected to sensor means for detecting the transmitted liquid level 15 and adapted to control one or more inlet valves of the inlet ports 11, and/or one or more outlet valves of the safety draining apertures 21, and/or one or more clean water pumps 23, and/or one or more sealing liquid discharge valves 36, and/or one or more inlet valves of the sealing liquid replenishment system 38. The control system 16 may perform said control/s in dependency on signals from the transmitted liquid level 15 sensor means and/or based on other criteria, e.g. regular liquid replenishment schedules, independent of the transmitted liquid level 15.

The transmitted liquid level 15 sensor means may comprise upper level sensors 17 (FIG. 8) responsive to an exceeding of a predetermined upper limit level 14 by the transmitted liquid level 15, and/or lower level sensors 18 responsive to when the transmitted liquid level 15 drops below a predetermined lower limit level 19, and/or liquid pressure sensors and/or optical sensors and/or electrical resistance sensors, all adapted to detect values representative of the transmitted liquid level 15.

The control system 16 may be configured in such a way that the transmitted liquid level 15 inside the transmission chamber 10 is maintained always below the interface/s 9. This prevents contact between the interface/s 9 and the transmitted liquid, thus eliminating the risk of mutual contamination, corrosion, and wear.

Figure 9:
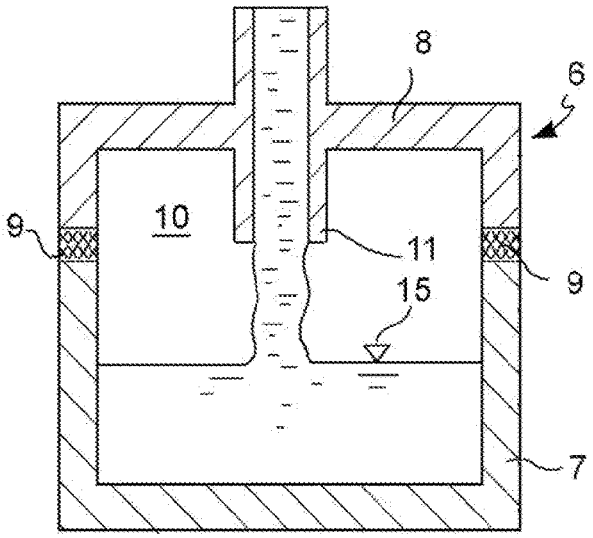
FIG. 9 is a vertical cross-section view of the buffer duct in FIG. 3 at a location of a liquid inlet port.

For the same purpose, the inlet port/s 11 and the outlet port/s 12 are arranged at a distance from the interface/s 9 and oriented in such a way that the transmitted liquid does not flow over or into the interface/s 9 (FIGS. 6 and 9).

Alternatively, or in addition, safety overflow apertures 20 may be positioned in the lower duct portion 7 for automatically gravity-draining excess transmitted liquid, above the upper limit level 14 but still below the interface/s 9. Alternatively, or in addition, the outlet port/s 12 or additional safety draining apertures 21 in the bottom of the lower duct portion 7 may be provided with level- or pressure-controlled safety valves for automatically gravity-draining excess transmitted liquid above the upper limit level 14 but still below the interface/s 9 (FIG. 8).

Figure 8:
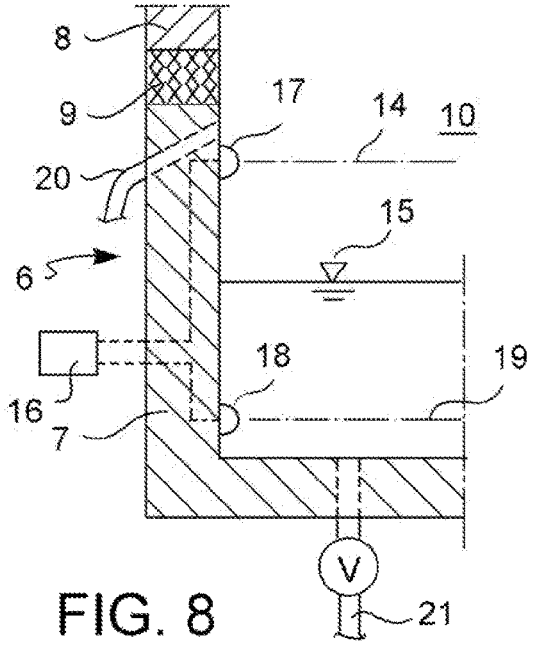
FIG. 8 is a vertical cross-section view of a lateral-inferior part of the buffer duct in accordance with an embodiment.

The control system 16 may be further configured in such a way that, in one or more selected buffer ducts 6 (chiefly for clean water transmission), the transmitted liquid level 15 inside the transmission chamber 10 is maintained always at or above a predetermined lower limit level 19 (FIG. 8). This is one way to obviate the risk of running out of transmitted liquid, especially drinking water or firefighting water, necessary for the purpose of downstream pumping and pressurizing.

In the case of a fire emergency, flexible hoses fixed to the stationary core 2 may be reeled out manually and brought onto the rotatable story 3, whose movement can be stopped for this purpose, to supply additional firefighting water.

Alternatively, or in addition, in the case of an emergency requiring a significant amount of clean water to be brought in a short time to the rotatable story 3, or in the case of any malfunctioning of the clean water transmission system 1 (e.g. due to water contamination in the clean water transmission chamber 10), flexible hoses may be arranged to connect the stationary core 2 to the rotatable story 3, whose movement can be stopped for this purpose, thus ensuring a continued clean water supply to the clean water pressure accumulation tank/s 51. Such connection could be realized by plugging the flexible hoses' nozzles into emergency ports positioned on the rotatable story 3 and/or the stationary core 2. The hoses may be fixed to one of the stationary core 2 or the rotatable story 3. Alternatively they may be entirely loose and transportable, in which case they may be brought up to the level of the rotatable story 3 during the emergency. The hoses and emergency water supply system are not illustrated in the figures.

In an embodiment (FIGS. 3, 4A, 4B, 4C, and 4D) the upper duct portion 8 forms an annular upper duct cover extending along the entire circumferential length of the buffer duct 6 and engaging the lower duct portion 7 continuously along two lateral interfaces 9, both extending along the entire circumferential length of the buffer duct 6. In this embodiment, during rotation of the story 3, the entire upper duct cover rotates with respect to the annular lower duct portion 7, while remaining in continuous concentric circumferential overlap and alignment with the lower duct portion 7.

In a further embodiment (FIGS. 5, 6 and 7) the lower duct portion 7 forms a nearly closed tubular channel except for a slot 22 extending along the entire circumferential length of the lower duct portion 7, and that may be formed in a top wall or in an upper side wall of the lower duct portion 7. The interface 9 is arranged at the slot 22 and the upper duct portion 8 forms a pipe extending preferably from above through the slot 22 and interface 9 into the annular transmission chamber 10 defined inside the lower duct portion 7. In this embodiment, during rotation of the story 3, only the relatively small pipe moves with respect to the lower duct portion 7, along the slot 22, while remaining in continuous radial and vertical alignment with the lower duct portion 7.

Figure 10:
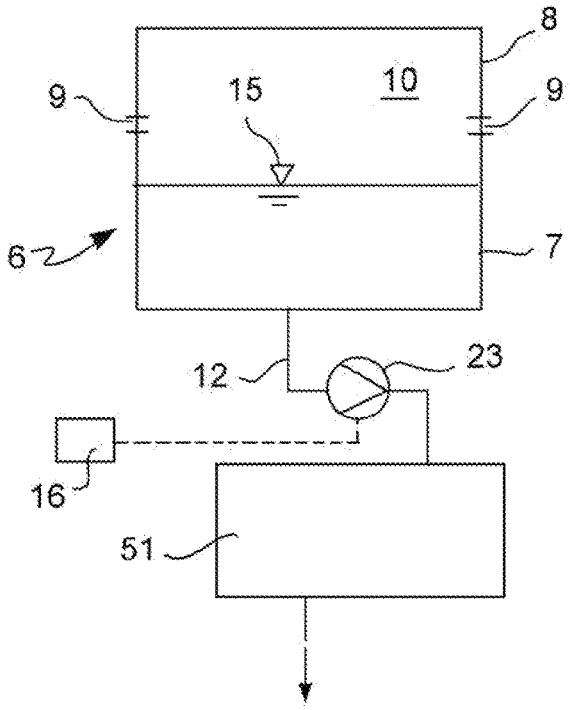
FIG. 10 is a schematic vertical cross-section view of the buffer duct in FIG. 3 at a location of a liquid outlet port from which the liquid is conveyed to a pump, which can then supply it with a service pressure, e.g. in the case of household drinking water.

FIGS. 3 to 7 show a variety of possible shapes for the upper and lower duct portions 8, 7. Such shapes are only illustrative and can be used in combination with one another. FIG. 10 shows an embodiment of the system 1 adapted for clean water supply to a rotatable story 3, in which the buffer duct 6 contains transmitted clean water at atmospheric pressure and the outlet port 12 is connected to a clean water pressure accumulation tank 51 with the interposition of a clean water pump 23, which may be controlled by the control system 16, for pumping the clean water from the buffer duct 6 into the clean water pressure accumulation tank 51 and for increasing the water pressure in the clean water pressure accumulation tank 51 to a desired value, e.g. 3 bar. The pressure accumulation tank 51 may comprise a hydraulic accumulator (not described in detail because per se well known in the art) for stabilizing the water pressure and compensating non-constant water usage in the rotatable story 3.

The clean water transmission system 1 may comprise more than one said clean water buffer duct 6 (for a same rotatable story) to enable the transmission to the rotatable story 3 of clean water at different temperatures.

Figure 11:
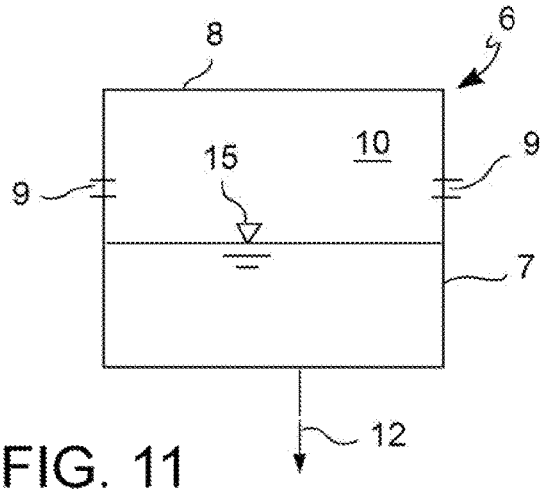
FIG. 11 is a schematic vertical cross-section view of the buffer duct in FIG. 3 at a location of a liquid outlet port in which the liquid is drained by gravity, e.g. household wastewater.

FIG. 11 shows an embodiment of the system 1 adapted for wastewater disposal from a rotatable story 3 to a stationary core 2, in which the buffer duct 6 contains transmitted wastewater at atmospheric pressure and the outlet port 12 is connected directly to a wastewater disposal duct of the core 2. Usually the wastewater will fall into the buffer duct 6, flow towards the outlet port/s 12 and immediately drain through the outlet ports 12 into the wastewater disposal duct of the core 2 without accumulating inside the annular transmission chamber 10.

Figure 12:
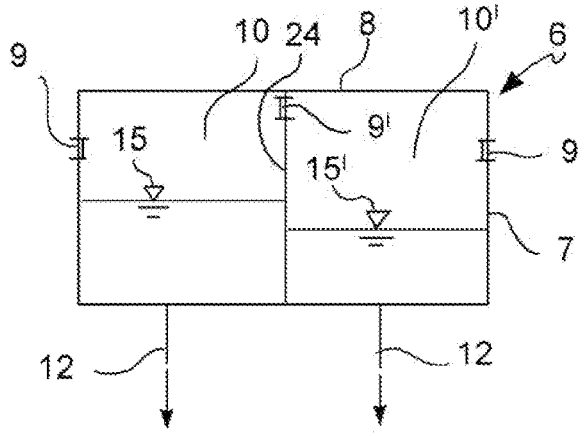
FIG. 12 is a schematic vertical cross-section view of the buffer duct in FIG. 3 with a double transmission chamber, in which two liquids are drained separately by gravity, e.g. household "grey" and "black" wastewater.

FIG. 12 shows an embodiment of the system 1 adapted for a separate transmission of different kinds of liquid by means of a single modified buffer duct 6, e.g. for so-called "grey" water (i.e. wastewater generated from washing food, clothes and dishware, as well as from bathing, but not from toilets) and "black" water (i.e. wastewater containing feces, urine and flush water from flush toilets and toilet paper). In this embodiment the buffer duct 6 defines two or more separate annular transmission chambers 10, 10' separated from each other by one or more internal separation walls 24 formed in and by the lower duct portion 7, one or more separate inlet ports 11 for each one of the transmission chambers 10, 10' and one or more separate outlet ports 12 for each one of the transmission chambers 10, 10'.

If an at least dust proof separation is required between adjacent transmission chambers 10, 10' of the same buffer duct 6, one or more additional interfaces 9' can be arranged between the internal separation wall/s 24 and the upper duct portion 8. The additional interface/s 9' can be made in a similar way as the interface/s 9.

Figure 13:
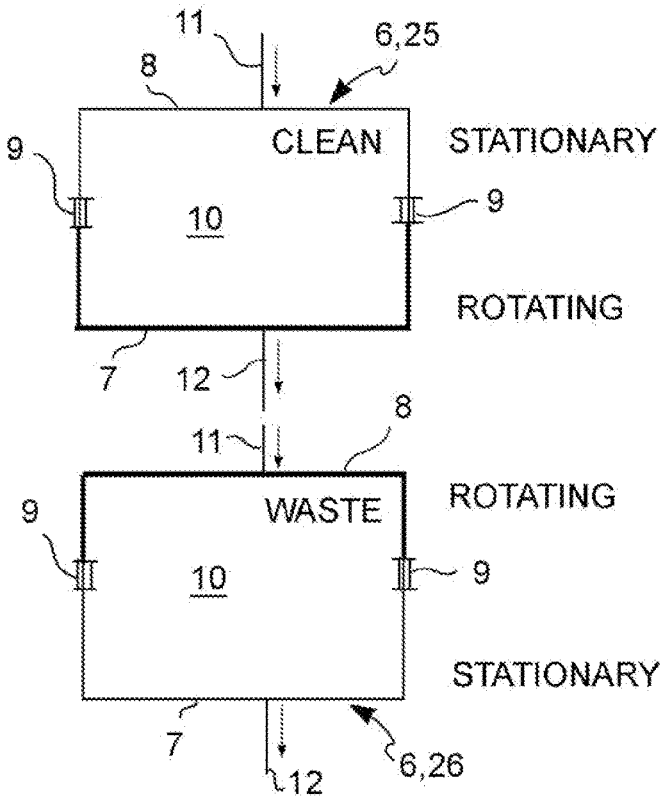
FIG. 13 shows schematically a relative movement between rotatable and stationary buffer duct portions in a liquid transmission system between a stationary core and a rotatable story of a building.

FIG. 13 schematically shows an embodiment in which the system 1 comprises, for one, more or each one of the rotatable stories 3:

- one or more of said buffer ducts 6 forming one or more supply ducts 25 for supplying a liquid, e.g. drinking water, firefighting water, from the stationary core 2 to the rotatable story 3, and
- one or more of said buffer ducts 6 forming one or more drain ducts 26 for discharging a liquid, e.g. wastewater, from the rotatable story 3 to the stationary core 2.

In the exemplary embodiment of FIG. 13, the upper duct portion 8 of the supply duct 25 is stationary together with the core 2 and the lower duct portion 7 of the supply duct 25 rotates together with the story 3, whereas the upper duct portion 8 of the drain duct 26 rotates together with the story 3 and the lower duct portion 7 of the drain duct 26 is stationary together with the core 2.

Figure 14:
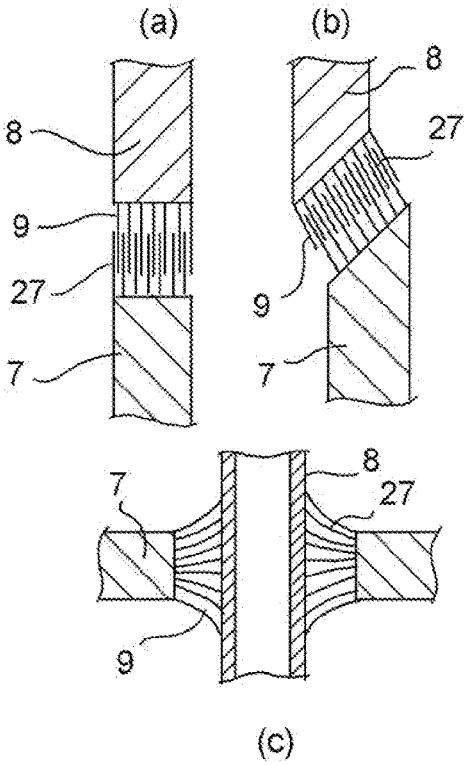
FIG. 14 shows cross-section views of brush sealed/covered/closed interface regions between upper and lower buffer duct portions in accordance with embodiments of the invention.
Figure 15:
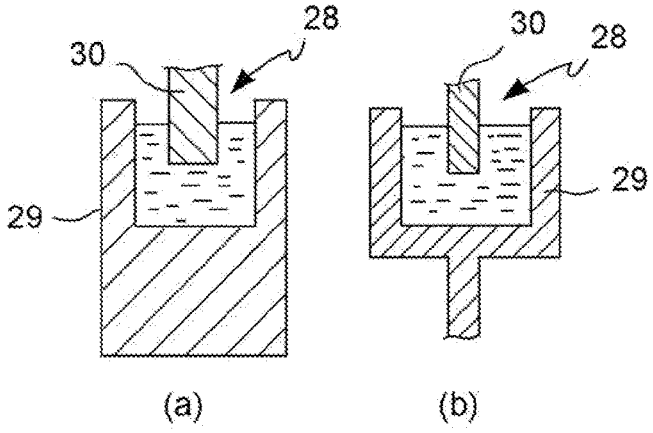
FIG. 15 shows cross-section views of liquid sealed interface regions between upper and lower buffer duct portions in accordance with embodiments of the invention.

In embodiments, the interface/s 9 comprise/s a dust proof interface seal, e.g.:

- a single sided or double sided brush seal 27 (FIGS. 14*a*, 14*b* and 14*c*),
- a liquid seal 28 (FIGS. 15, 16A and 16B),
- a labyrinth seal, which closes the interface/s 9 in an at least dust proof manner, preferably in a dust and odor proof manner, even more preferably in a dust, odor and water repellent manner, so as to make the buffer duct 6 of a substantially closed cross-section and to effectively separate and protect the liquid flowing through the annular transmission chamber 10 from the ambient, and vice versa.

One or more horizontal surfaces of the interface/s 9 may be covered with damping layers (not illustrated in the figures) made of shock absorbing material such as some polymers, in order to protect the interface/s 9, as well as to contribute to the damping of the entire building 4, during extreme events such as earthquakes.

It should be understood that any alternative component, either known in the art or yet to be invented, of the interface/s 9, other than a ring seal, falls within the scope of the present invention. The term "ring seal" is to be construed as a solid elastomeric mechanical gasket in the shape of a torus.

The liquid seal 28 comprises a trough 29 containing a sealing liquid (preferably water), and a lip, wall or sheet 30 projecting from above into the trough 29 and being immersed in the sealing liquid, wherein the trough 29 forms the lower duct portion 7 face of the interface 9, and the lip, wall or sheet 30 forms the upper duct portion 8 face of the interface 9, or vice versa.

In the liquid seal 28 the radial and vertical clearance between the lip, wall or sheet 30 and the internal walls and bottom of the trough 29 must be sufficient to ensure that during a destabilizing event such as an earthquake the lip, wall or sheet 30 will not come in contact with the internal walls and/or the bottom of the trough 29.

Moreover, the immersed portion of the lip, wall or sheet 30 must be sufficiently high to ensure immersion of the lip, wall or sheet 30 and, hence, its sealing ability, also when the entire rotatable story 3, or part of it, is lifted, e.g. for maintenance.

Figure 16A:
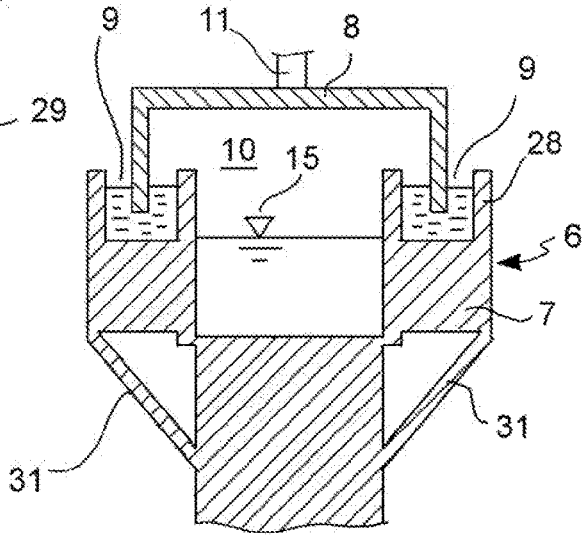
FIG. 16A is a vertical cross-section view of a liquid sealed buffer duct in accordance with an embodiment of the invention.
Figure 16B:
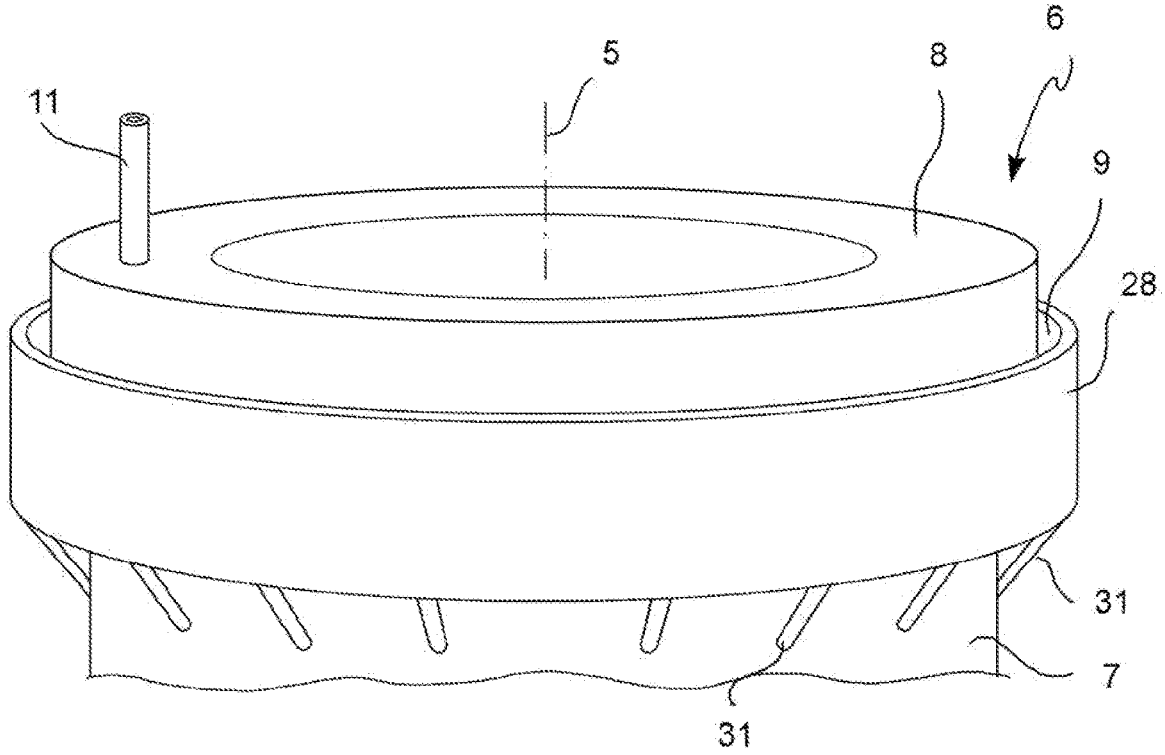
FIG. 16B is a perspective view of the buffer duct in FIG. 16A.

FIGS. 16A and 16B show an exemplary embodiment in which the lower duct portion 7 comprises auxiliary support struts 31 extending externally on both sides of the buffer duct 6 from a bottom part of the lower duct portion 7 to a laterally protruding side wall of the trough 29 of the liquid seal 28.

Figure 17A:
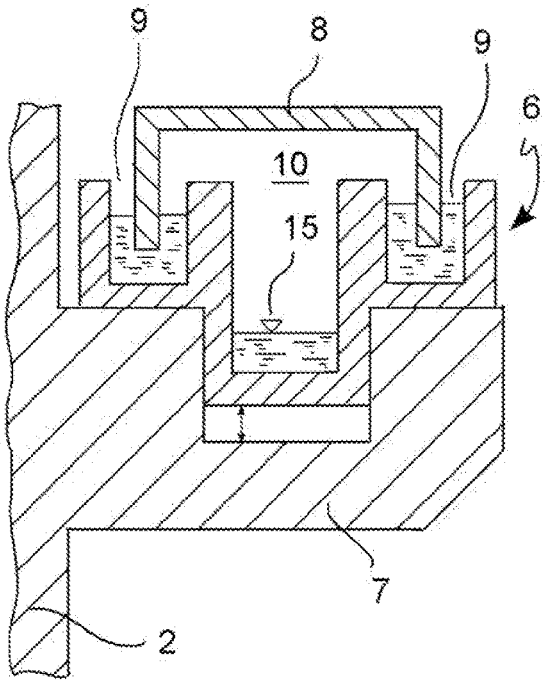
FIG. 17A is a vertical cross-section view of a liquid sealed buffer duct in accordance with a further embodiment of the invention.
Figure 17B:
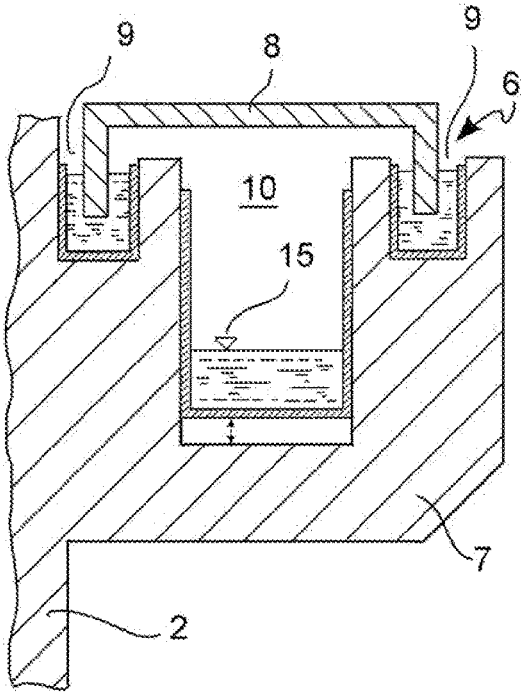
FIG. 17B is a vertical cross-section view of a liquid sealed buffer duct in accordance with a further embodiment of the invention.

FIG. 17A shows an exemplary embodiment in which the lower duct portion 7 is supported by a ledge extending substantially circumferentially from the stationary core 2. FIG. 17B shows an embodiment wherein the lower duct portion 7 is formed as an extension of the stationary core 2, wherein troughs are formed in said extension to form the transmission chamber 10 and both interface 9 liquid seal 28 troughs 29, and wherein sheaths or linings are placed in said troughs, i.e. the transmission chamber 10 and interface 9 liquid seal 28 troughs 29, to ensure impermeability. The troughs are thus coated with such sheaths or linings, which are made of an impermeable material, preferably high-density polyethylene (HDPE) or polytetrafluoroethylene (PTFE).

In an embodiment, the transmission chamber 10 bottom reaches its maximum height or locally highest point 32 in a region or section of the transmission chamber 10 close to where the liquid seal 28 trough 29 bottom reaches its point of minimum height or locally lowest point 40.

The liquid seal 28 may comprise a drainage system which allows the sealing liquid to flow out of the liquid seal 28, and a replenishing system 38 for feeding fresh sealing liquid into the liquid seal 28, thus preventing the sealing liquid from becoming stagnant.

The sealing liquid replenishing system 38 comprises a replenishing duct system with one or more replenishing pumps and/or one or more replenishing valves, which may be controlled by the control system 16 or via other means, for the purpose of replenishing the liquid seal 28 trough 29 with sealing liquid.

Figure 18A:
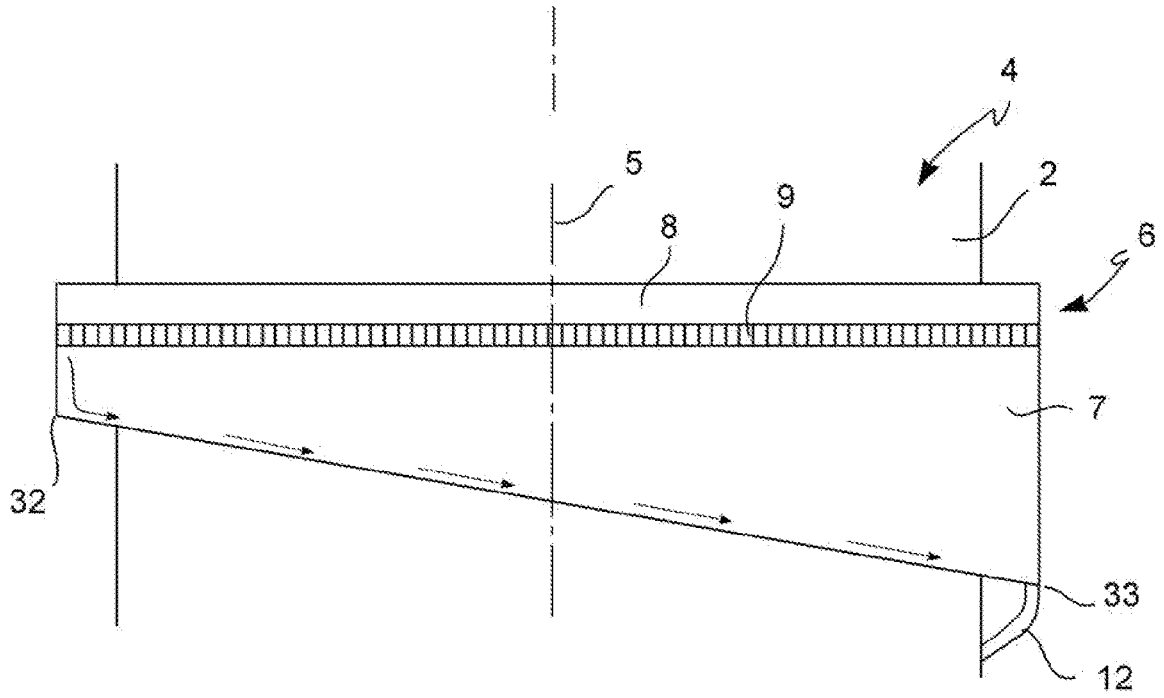
FIG. 18A is a schematic side view of a variable height buffer duct, preferably a wastewater buffer duct, arranged around a stationary core of a building, according to an exemplary embodiment of the invention.
Figure 18B:
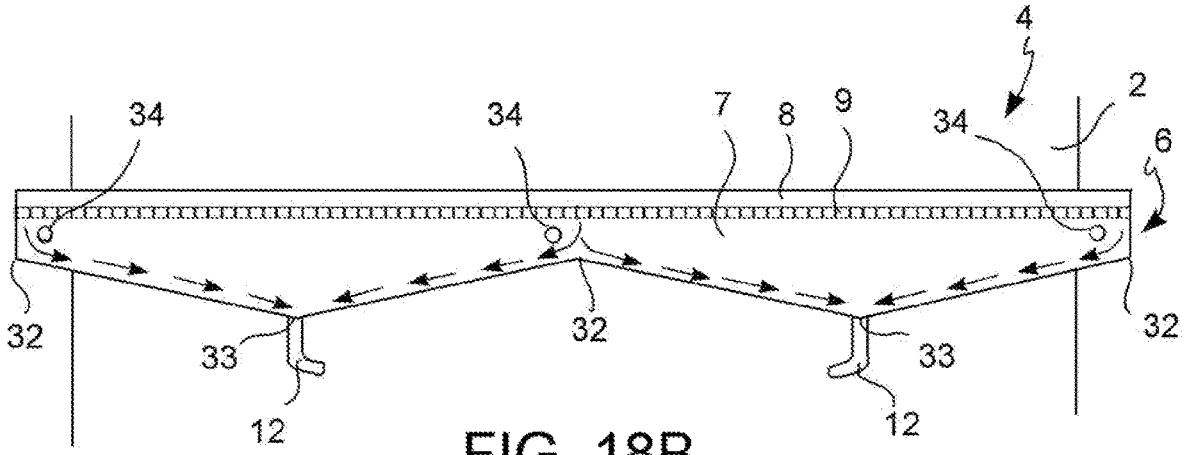
FIG. 18B is a schematic side view of a variable height buffer duct, preferably a wastewater buffer duct, arranged around a stationary core of a building, according to a further embodiment of the invention.

FIGS. 18A and 18B show embodiments in which all or a portion of the bottom of the annular transmission chamber 10 slopes downwards from one or more locally highest points 32 to one or more locally lowest points 33 where the outlet ports 12 are arranged, thereby driving the flow of liquid towards the outlet ports 12 by means of gravity and avoiding stagnation of liquid. This is particularly advantageous for a possibly complete evacuation of the buffer duct 6 when used for wastewater disposal from the rotatable story 3 to the stationary core 2. The possibility of completely emptying the buffer duct 6 without leaving residual pools of stagnant water or disinfectant solution is also of considerable benefit for clean water transmission from the stationary core 2 to the rotatable story 3.

In an embodiment (FIG. 18A) the bottom of the annular transmission chamber 10 forms only one highest point 32 and only one lowest point 33 which are preferably arranged at a pitch of approximately 180° with the advantage of needing only one outlet port 12 and also only one inlet port 11.

In alternative embodiments (FIG. 18B) the bottom of the annular transmission chamber 10 forms a plurality of locally highest points 32 and locally lowest points 33 arranged alternately in succession along the entire circumferential length of the buffer duct 6, e.g. at a pitch of approximately 90°, 60°, 45°, 36°, 30°, or any of 360°/(2n) where n is a strictly positive integer, with the advantage of a steeper sloping bottom without excessively increasing the total height of the buffer duct 6, but with the need of a plurality of outlet ports 12 corresponding to the number of locally lowest points 33. In the case of drinking water and firefighting water, there would also be a plurality of inlet ports 11 at least equal to the number of locally lowest points 33 and arranged so that all outlet ports 12 can be supplied with liquid in each rotational position of the upper duct portion 8 with respect to the lower duct portion 7. This requirement does not apply to wastewater disposal from the rotatable story 3 to the stationary core 2.

In the case of wastewater, a plurality of outlet ports 12 has the advantage of enabling wastewater disposal from the rotatable story 3 to the stationary core 2 even in the event that one or more of the outlet ports 12 clog up.

It should be understood that, whichever liquid is transmitted, an embodiment in which the transmission chamber 10 bottom does not vary in height falls within the scope of the present invention.

In an embodiment the system 1 comprises a flushing means adapted to convey a flushing liquid in the buffer duct 6 through one or more flushing ports 34 opening out into the transmission chamber 10 at a distance from the inlet port/s 11. While flushing and cleaning of the drain duct 26 can be also carried out by feeding a flushing liquid through the inlet ports 11, one or more separate and independent flushing ports 34 can direct the flushing liquid flow in a more purposeful manner, may comprise spraying nozzles and/or flushing flow orientation adjustment means, or may be orientable or oriented to flush also at least part of the interface/s 9. The flushing means may comprise pumping means to pump the flushing liquid through the flushing port/s 34.

Figure 19A:
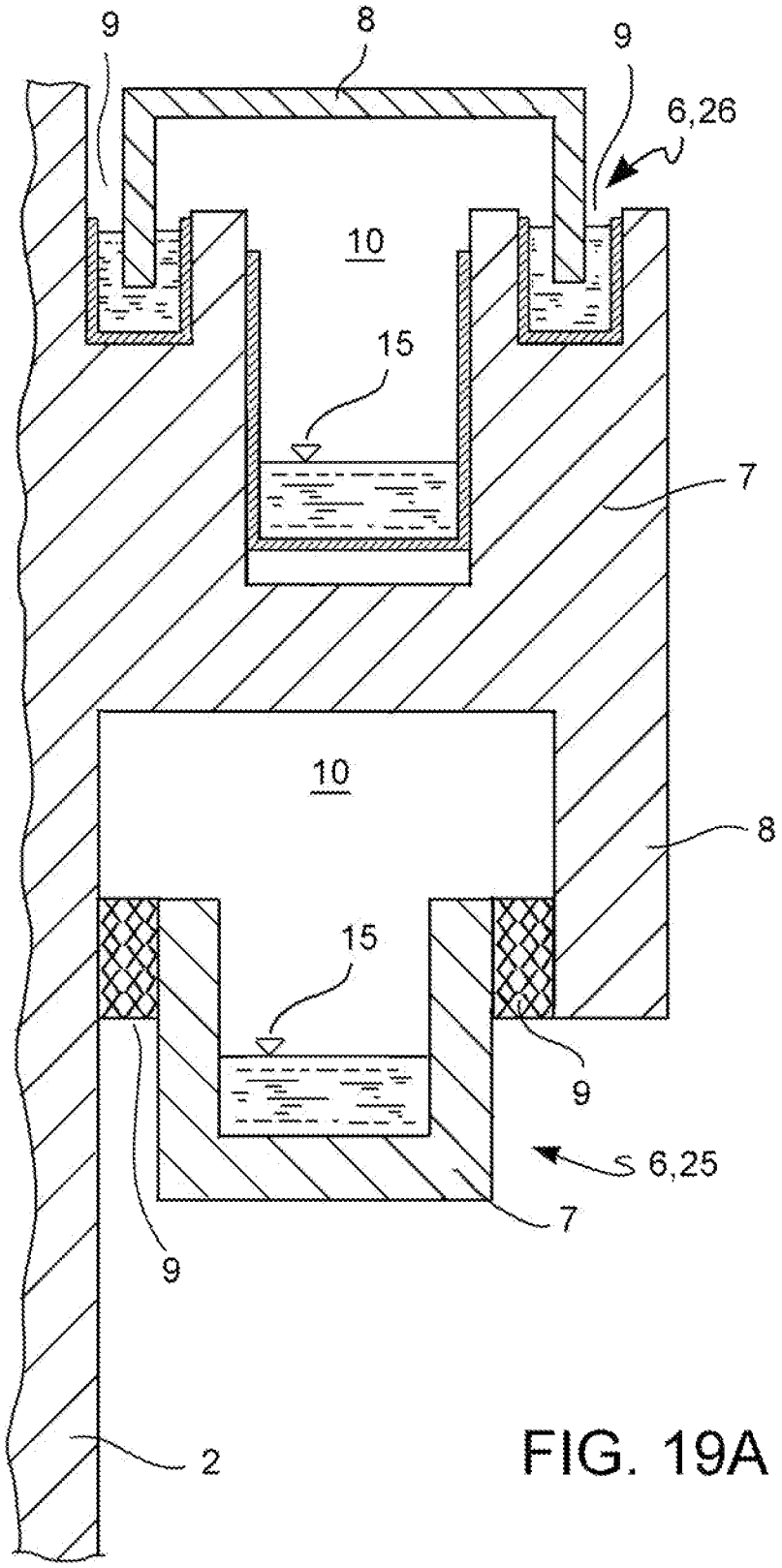
FIG. 19A is a vertical cross-section view of a buffer duct for the transmission of wastewater, in line with the embodiment shown in FIG. 17A, positioned directly above a buffer duct for the transmission of clean water, in line with the embodiment shown in FIG. 4D. The story from which wastewater is discharged via said wastewater buffer duct is positioned directly above the story to which clean water is supplied via said clean water buffer duct.
Figure 19B:
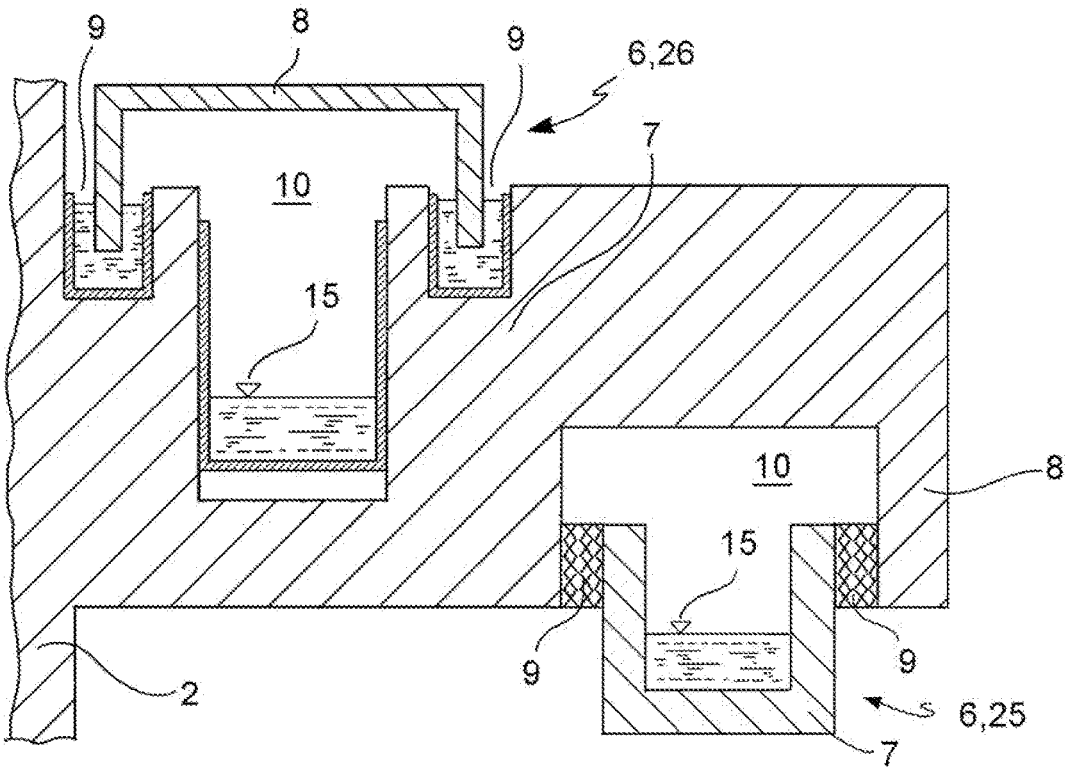
FIG. 19B is a vertical cross-section view of the wastewater and clean water buffer ducts shown in FIG. 19A, in which the clean water buffer duct is at a greater radial distance from the core than is the wastewater buffer duct.
Figure 19C:
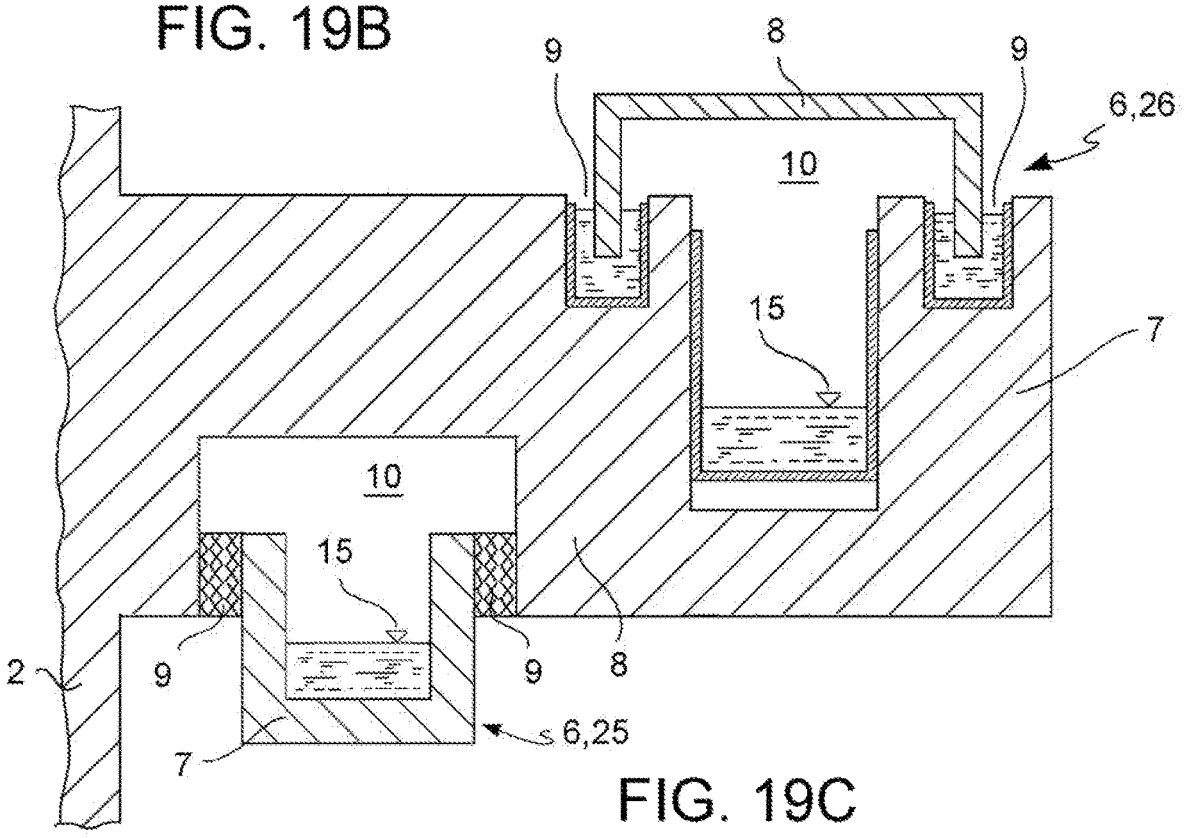
FIG. 19C is a vertical cross-section view of the wastewater and clean water buffer ducts shown in FIG. 19A, in which the clean water buffer duct is at a smaller radial distance from the core than is the wastewater buffer duct.

In embodiments (FIGS. 19A to 20B), the lower portion 7 of the wastewater buffer duct 6 of a given rotatable story 3 and the upper portion 8 of the clean water buffer duct 6 of a rotatable story 3 positioned directly beneath said given rotatable story 3 are formed in a same stationary core 2 wall portion (e.g. a substantially radially outward protruding portion of the stationary core 2), which has the advantage of simplifying the structure of the system 1. The wastewater and clean water buffer ducts 6 may be positioned one above the other (FIG. 19A) or, in order to minimize the vertical space occupied by said system 1, may be positioned at different radial distances from the core 2 (FIGS. 19B and 19C).

Figure 20A:
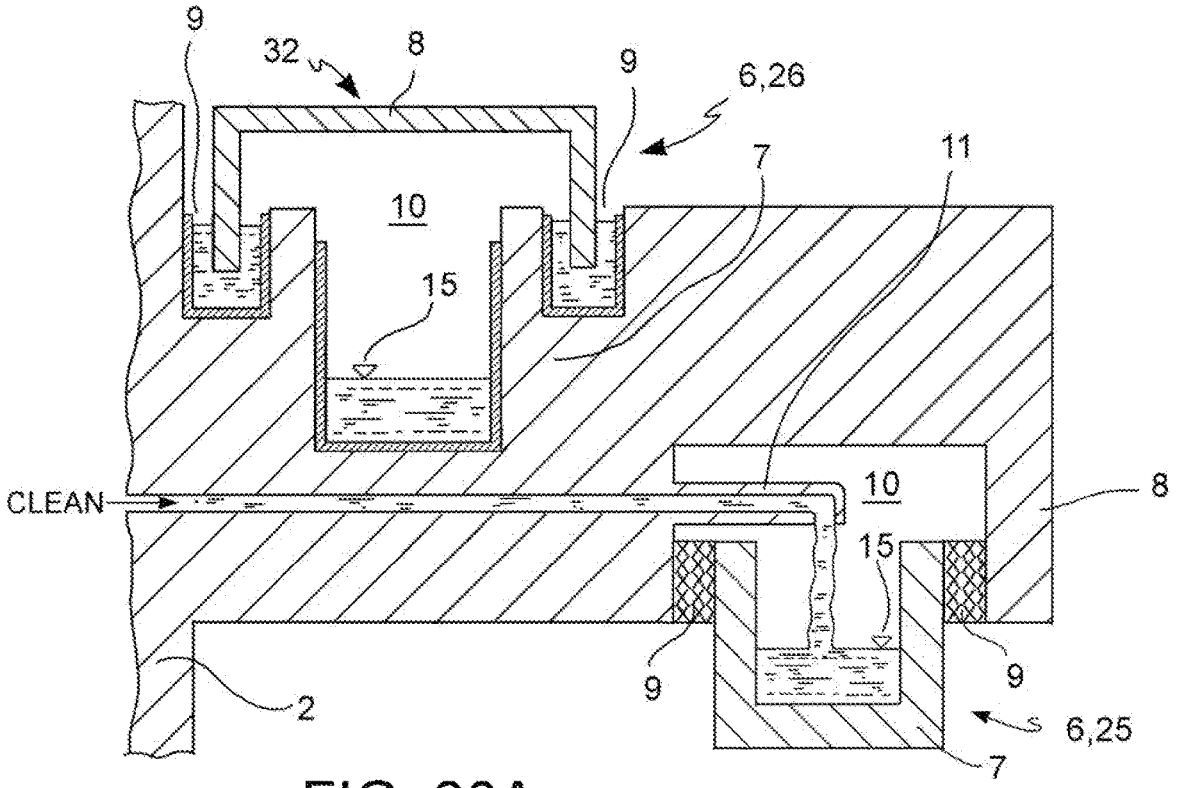
FIG. 20A is a vertical cross-section view of the wastewater and clean water buffer ducts shown in FIG. 19B, at one of the locally highest points of the wastewater transmission chamber.
Figure 20B:
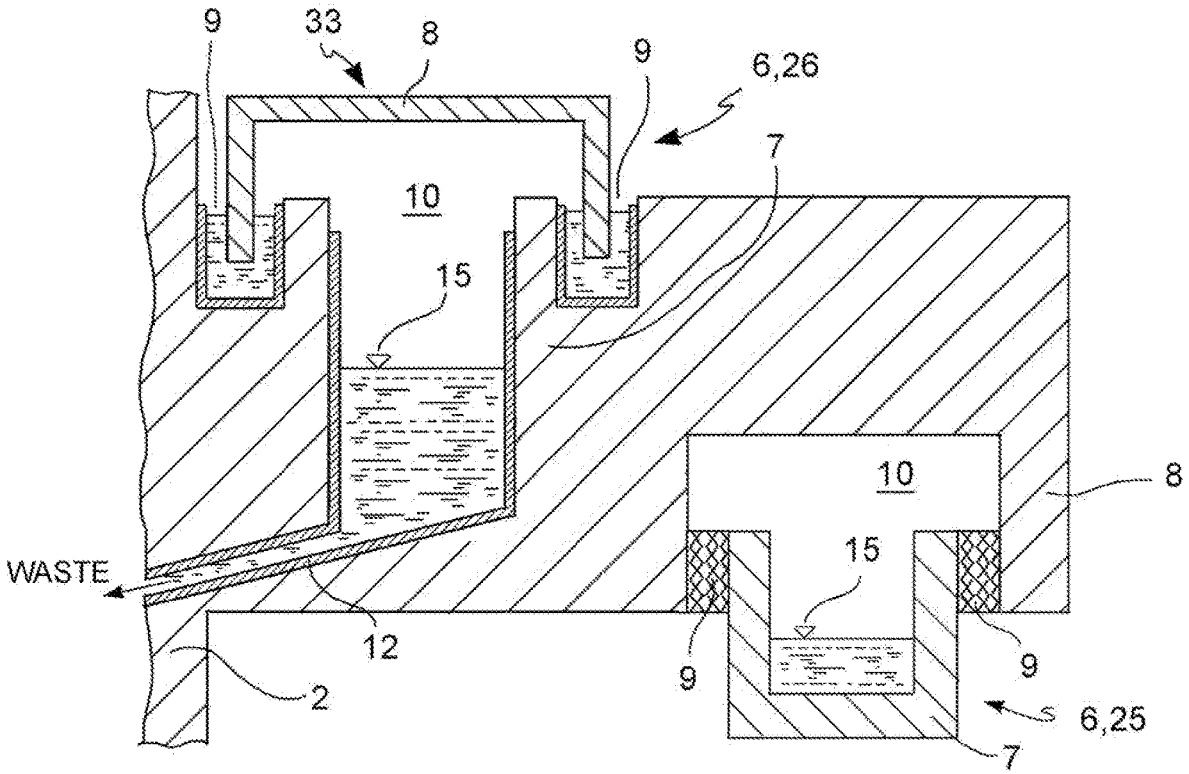
FIG. 20B is a vertical cross-section view of the wastewater and clean water buffer ducts shown in FIG. 19B, at one of the locally lowest points of the wastewater transmission chamber.

In line with this embodiment, and with the aforementioned embodiment of a variable height wastewater transmission chamber 10, the clean water buffer duct 6 may be positioned at a greater radial distance from the core 2 than the radial distance of the wastewater buffer duct 6 from the core 2. In order to further minimize the vertical space occupied by the system 1, and to minimize the materials required for the construction of the system 1, each clean water supply line to the clean water buffer duct 6 may be arranged to extend through the core 2 under a locally highest point 32 of the wastewater transmission chamber 10 bottom (FIG. 20A) extending above it. Each wastewater buffer duct 6 outlet port 12 is hence at a distance from, and not above, the clean water transmission chamber 10, thus further reducing the risk of the liquids mixing, even in the event of catastrophic occurrences (FIG. 20B). The geometry of this embodiment is such that, in the event of an overflow of the wastewater transmission chamber 10 (e.g. due to the clogging up of one or more outlet ports 12), wastewater cannot enter the clean water transmission chamber 10 (FIGS. 20A and 20B).

In general, in order to further reduce the risk of the liquids mixing, all wastewater transmission chambers 10 and outlet ports 12 may be coated with impermeable material. Impermeable material may also coat the surfaces surrounding the wastewater transmission chamber 10, in order to prevent overflown wastewater to seep through the structural material (e.g. concrete) into the clean water transmission chamber 10.

Figure 21A:
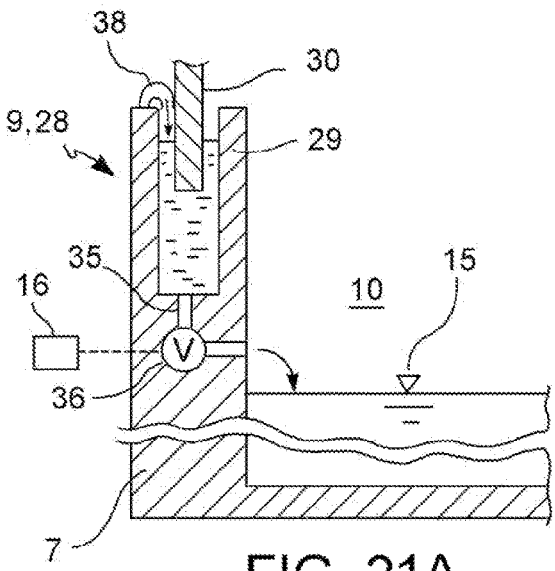
FIG. 21A shows, in a vertical cross-section view, the evacuation of sealing liquid from a liquid seal of a buffer duct by means of discharge from the bottom, e.g. at a point of minimum height of the liquid seal trough bottom and near a point of maximum height of the transmission chamber bottom.

FIG. 21A shows an embodiment in which the aforementioned liquid seal 28 drainage system functions by discharging the sealing liquid from the interface 9 liquid seal 28 into the annular transmission chamber 10 by means of one or more sealing liquid discharge ducts 35 connecting the bottom of the liquid seal 28 trough 29 to the transmission chamber 10, preferably above the upper limit level 14 to prevent backflow, and having one or more sealing liquid discharge valves 36 or plugs or shutters.

Figure 21B:
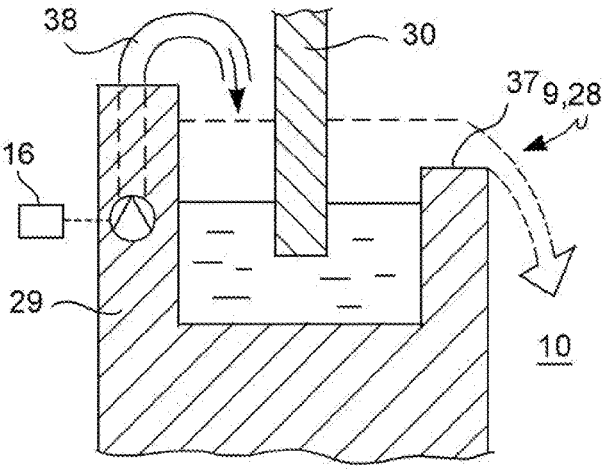
FIG. 21B shows, in a vertical cross-section view, the evacuation of sealing liquid from a liquid seal of a buffer duct by means of an overflow, e.g. near or at a point of maximum height of the transmission chamber bottom.

FIG. 21B shows an embodiment in which the aforementioned liquid seal 28 drainage system functions by discharging part of the sealing liquid from the interface 9 liquid seal 28 into the annular transmission chamber 10 by over-replenishment of sealing liquid into the liquid seal 28 trough 29 and overflow of excess sealing liquid above one or more internal overflow wall sections 37 of the trough 29 having a calibrated height which is lower than the external wall of the trough 29. Any embodiment other than the one in which there is only one overflow wall section 37 running along the entire internal wall of the liquid seal 28 trough 29 (wherein the sealing liquid's overflow is hence circumferentially uniform along the internal wall of the trough 29) generates, during said overflow, a horizontal flow of sealing liquid within the liquid seal 28 trough 29, which advantageously further helps prevent the sealing liquid from stagnating. Said over-replenishment can occur by means of the sealing liquid replenishment system 38 described above.

In order to ensure that the sealing liquid fills the liquid seal 28 trough 29 to a minimum level, thus ensuring that the liquid seal 28 maintains its sealing ability, a control system (not illustrated in the figures) for the monitoring of sealing liquid levels similar to (or integrated in or connected to) the control system 16 described above for controlling transmitted liquid levels in the transmission chamber 10, may be configured to control the sealing liquid level and/or to replenish sealing liquid in the liquid seal 28 trough 29.

As described in connection with the flushing of the transmission chamber 10, a similar flushing effect is performed also by the sealing liquid discharge into the transmission chamber 10 by the liquid seal 28 drainage system. Said flushing of the transmission chamber 10, via any of the mechanisms described above (flushing port/s 34, sealing liquid discharge duct/s 35 or internal overflow wall section/s 37), can be controlled manually, and/or by the control system 16, and/or by any other means. It can also be set to be performed regularly and/or automatically at predetermined times, in order to ensure a constant minimal level of cleanliness, especially in the case of a wastewater transmission chamber 10.

As described in connection with the flushing of the transmission chamber 10, the liquid seal 28 trough 29 bottom may form a plurality of locally highest points 39 and locally lowest points 40 arranged alternately in succession along the entire circumferential length of the buffer duct 6, e.g. at a pitch of approximately 90°, 60°, 45°, 36°, 30°, or any of 360°/(2n) where n is a strictly positive integer, with the advantage of a steeper sloping bottom without excessively increasing the total height of the trough 29.

Figure 22A:
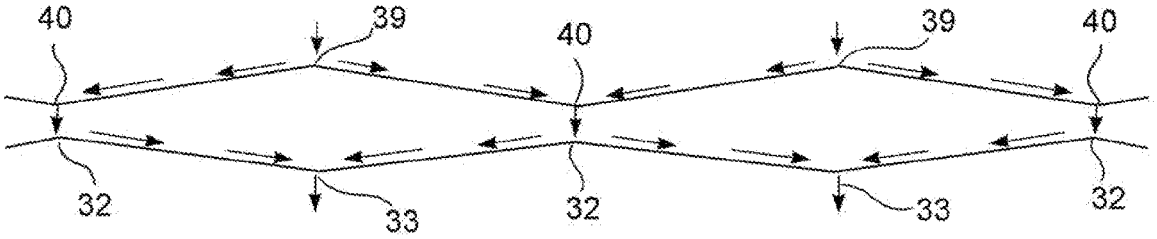
FIG. 22A shows a sealing liquid flow and discharge scheme along a section of a variable height liquid seal trough bottom and of a variable height transmission chamber bottom.

In the presence of the sealing liquid discharge duct/s 35 described above, multiple liquid seal 28 trough 29 bottom locally lowest points 40 may generate the need of a plurality of sealing liquid discharge ducts 35, corresponding to the number of locally lowest points 40. Advantageously, each liquid seal 28 trough 29 bottom locally lowest point 40, and hence each sealing liquid discharge duct 35, is arranged at or near the locally highest point/s 32 of the transmission chamber 10 bottom, to obtain a flow pattern as shown in FIG. 22A. It should be understood that, whether the sealing liquid discharge duct/s 35 is/are present or not, an embodiment in which the liquid seal 28 trough 29 bottom does not vary in height falls within the scope of the present invention.

Figure 22B:
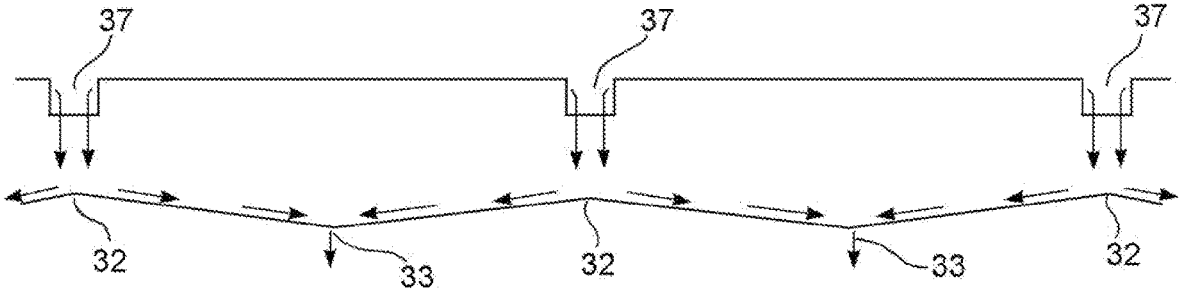
FIG. 22B shows a sealing liquid flow and discharge scheme along a section of a variable height transmission chamber bottom in the presence of liquid seal overflow wall sections.

FIG. 22B schematically shows the flow pattern of the combined liquid seal 28 drainage and transmission chamber 10 flushing by means of internal overflow wall sections 37. Such system has the advantage of both changing the sealing liquid in the liquid seal 28 and flushing the wastewater transmission chamber 10, in one single step.

Figure 23:
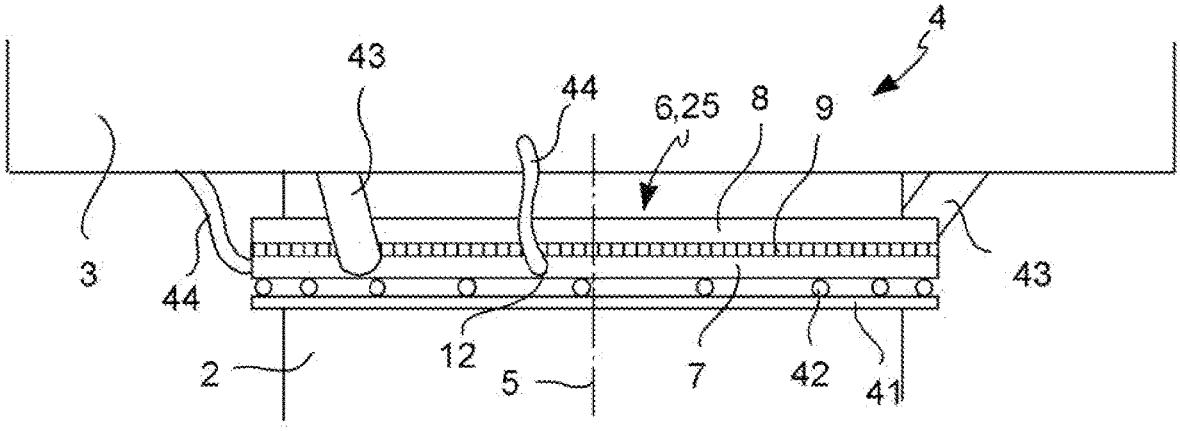
FIG. 23 shows, in a side view, the connection of a clean water buffer duct (of the type shown in FIG. 3) between a rotatable story and a stationary core of a rotatable building, with the buffer duct arranged below the rotatable story.

FIG. 23 shows the connection of a clean water buffer duct 6 (of the type shown in FIG. 3) between the rotatable story 3 and the stationary core 2 of the building 4, with the buffer duct 6 arranged below the rotatable story 3. In this embodiment the lower duct portion 7 (which must rotate together with the story 3) is supported by a substantially annular platform 41 fixed to or formed by the core 2, and made rotatable by means of rolling track means 42 or sliding means interposed between the platform 41 and the lower duct portion 7. The upper duct portion 8 (which must be stationary together with the core 2) is fixed to the core 2. In this manner, the entire weight of the buffer duct 6 is directly transmitted to the core 2. Dragging studs/members 43 connect the lower duct portion 7 to the story 3 so that they rotate together. One or more flexible pipes 44 connect the outlet ports 12 to the story 3 clean water system via the clean water pumps 23.

Figure 24:
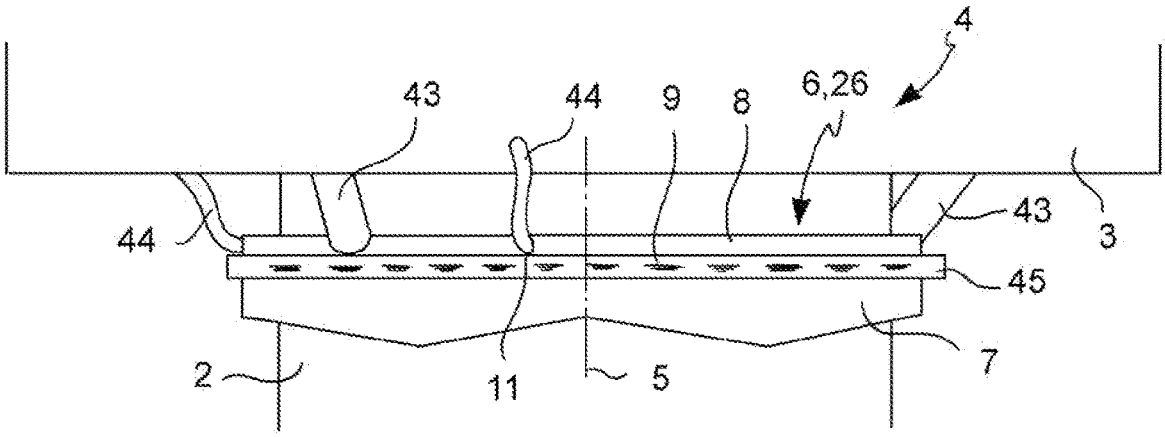
FIG. 24 shows, in a side view, the connection of a wastewater buffer duct (of the type shown in FIG. 3) between a rotatable story and a stationary core of a rotatable building, with the buffer duct arranged below the rotatable story.

FIG. 24 shows the connection of a wastewater buffer duct 6 (of the type shown in FIG. 3) between the rotatable story 3 and the stationary core 2 of the building 4, with the buffer duct 6 arranged below the rotatable story 3. In this embodiment the lower duct portion 7 (which must remain stationary together with the core 2) is fixed to the core 2. The upper duct portion 8 is rotatable together with the story 3 and can be vertically supported by means of an additional sustainment device 45 on the core 2 or on the lower duct portion 7. With such sustainment device 45 all or part of the weight of the buffer duct 6 is directly transmitted to the core 2. Dragging studs/members 43 connect the upper duct portion 8 to the story 3 so that they rotate together. One or more flexible pipes 44 connect the story 3 wastewater system to the inlet ports 11.

In the embodiments shown in FIGS. 23 and 24, the flexible pipe/s 44 may run through, and/or be made to coincide with, one or more of the dragging studs/members 43.

It should be understood that any embodiment of a wastewater buffer duct 6 lacking such additional sustainment device 45, and hence in which the entire weight of the upper duct portion 8 is supported by the rotatable story 3, falls within the scope of the present invention.

It should also be understood that embodiments in which the supply duct 25 and/or the drain duct 26 comprise non-flexible pipes fall within the scope of the present invention.

Figure 25:
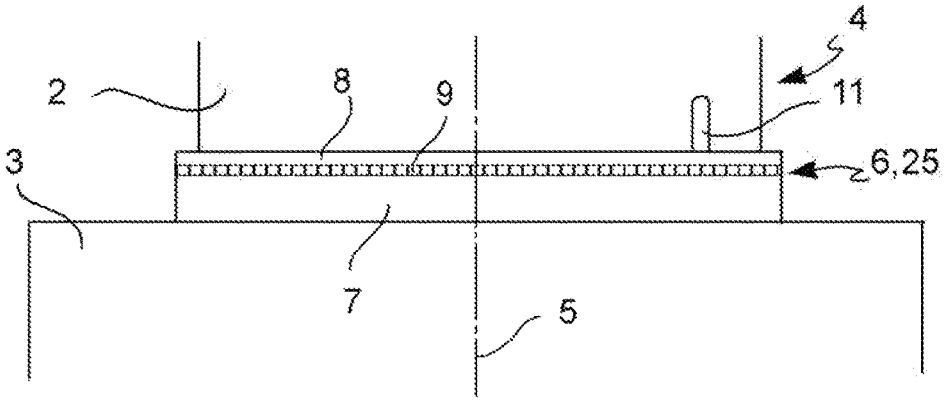
FIG. 25 shows, in a side view, the connection of a clean water buffer duct (of the type shown in FIG. 3) between a rotatable story and a stationary core of a rotatable building, with the buffer duct arranged above the rotatable story.
Figure 26:
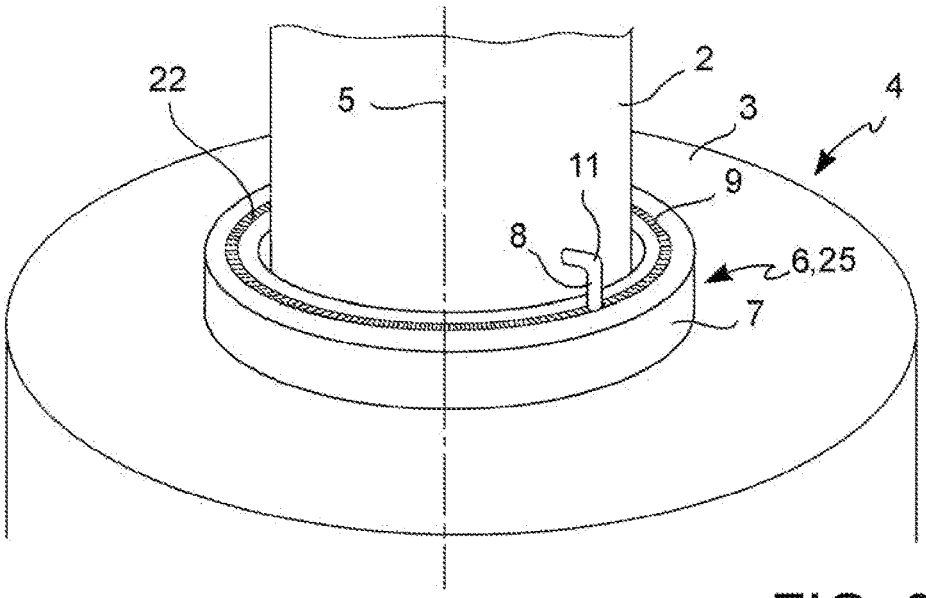
FIG. 26 shows, in a perspective view, the connection of a clean water buffer duct (of the type shown in FIG. 5) between a rotatable story and a stationary core of a rotatable building, with the buffer duct arranged above the rotatable story.

FIGS. 25 and 26 show the connection of a clean water buffer duct 6 (of the types shown respectively in FIGS. 3 and 5) between the rotatable story 3 and the stationary core 2 of the building 4, with the buffer duct 6 arranged above the rotatable story 3. In this embodiment the lower duct portion 7 (which must rotate together with the story 3) is directly supported by and fixed to the story 3. The upper duct portion 8 (which must be stationary together with the core 2) is fixed to the core 2. This embodiment obviates the need of dragging studs/members 43 and of rolling track means 42.

On the other hand, the system 1 may require and comprise additional compensation means for compensating a relative vertical displacement of the entire rotatable story 3, or part of it, with respect to the stationary core 2. Such vertical displacement may occur when the story 3 is lifted from its working position to a slightly higher maintenance position, e.g. during repair of elements, e.g. of the rolling track means 42, interposed between the rotatable story 3 and the stationary core 2.

Figure 27:
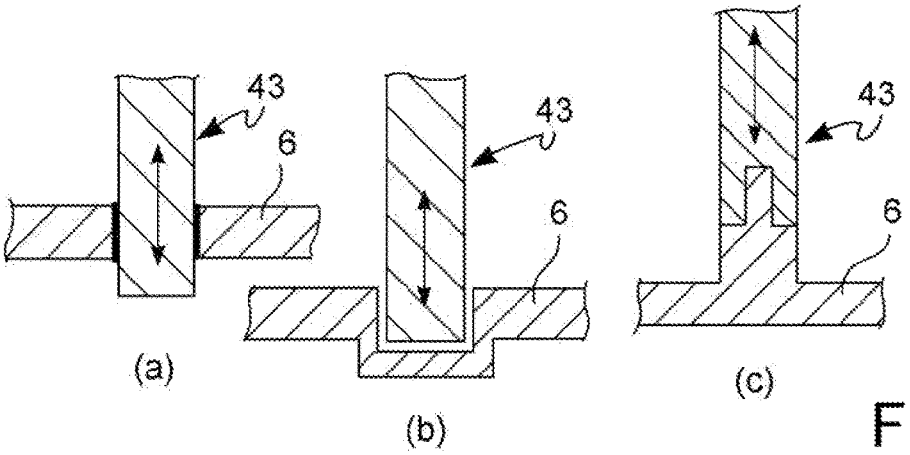
FIG. 27 shows, in vertical cross-section views, exemplary embodiments of the engagement/disengagement of dragging studs/members between buffer duct portions, for the purpose of allowing maintenance lifting of the rotatable story.

The additional compensation means may comprise one or more of:

first height adjustment means for adjusting the height of the upper duct portion 8 with respect to the core 2 (in case of a supply duct 25) or to the story 3 (in case of a drain duct 26), second height adjustment means for adjusting the height of the lower duct portion 7 with respect to the story 3 (in case of a supply duct 25) or to the core 2 (in case of a drain duct 26), the dragging studs/members 43 having a vertical sliding capability (FIGS. 27*a* and 27*b*) or a vertical telescoping or disengaging capability (FIG. 27*c*) with respect to the lower or upper portion 7, 8 of the buffer duct 6 with which they are in contact, a configuration of the interface/s 9 such as to allow for relative vertical movements (within predetermined limits) between the upper and lower duct portions 8, 7, without substantially changing their functional relationship, e.g.:

a sufficiently vertically extended lip, wall or sheet 30 and a sufficiently deep liquid seal 28 trough 29 and a sufficiently high sealing liquid level of the liquid seal 28 (FIG. 15), and/or sufficiently long bilateral brush bristles engaging one another in a sufficiently vertically extended overlapping height (FIGS. 14*a* and 14*b*), and/or the upper duct portion 8 forming a sufficiently vertically protruding pipe extending sufficiently deep through the slot 22 (FIGS. 5, 6 and 7).

Figure 28:
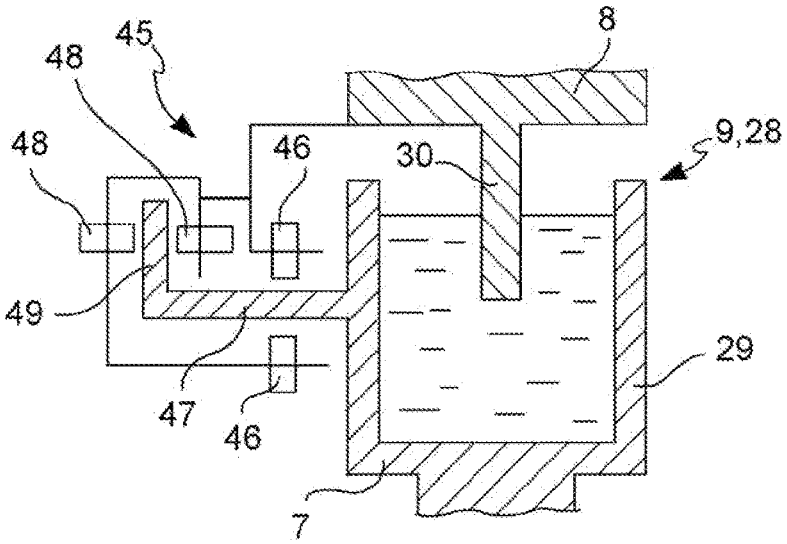
FIG. 28 is a schematic vertical cross-section view of an alignment device for aligning the upper and lower portions of a buffer duct in accordance with an embodiment.

The sustainment device 45 or, more generally, an alignment device for aligning the lower and upper duct portions 7, 8 may comprise vertically engaging first rollers 46 and one or more first rolling tracks 47 with a rolling direction that is circumferential to the reference axis 5, and/or horizontally engaging second rollers 48 and one or more second rolling tracks 49 with a rolling direction that is also circumferential to the reference axis 5, wherein the first rollers 46 and the first rolling track/s 47 are connected/fixed the ones to the upper duct portion 8 and the others to the lower duct portion 7, or vice versa, and the second rollers 48 and the second rolling track/s 49 are connected/fixed the ones to the upper duct portion 8 and the others to the lower duct portion 7, or vice versa, as schematically shown in FIG. 28. The engagement of said rollers (46, 48) with said rolling tracks (47, 49) may not be exactly vertical and horizontal, and may be e.g. inclined to the vertical.

Such alignment means ensure the planned relative position between the upper and lower duct portions 8, 7, thereby preventing undesired disengagement of the interface/s 9, preventing leakage of undesired odors in case of wastewater disposal, and transmitting forces and gravitational loads between the upper and lower duct portions 8, 7.

Figure 29A:
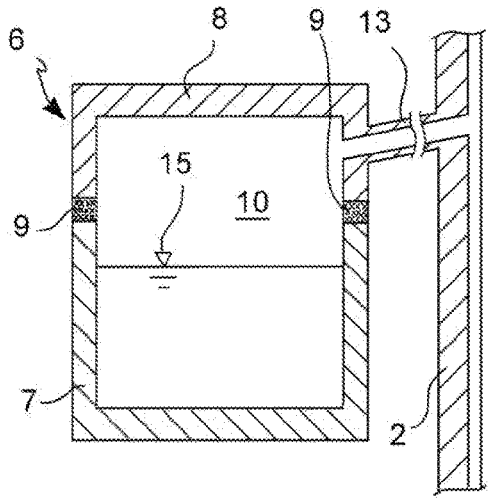
FIG. 29A is a vertical cross-section view of an embodiment of a buffer duct having a vent-to-core venting duct to maintain atmospheric pressure, the vent being connected to the upper duct portion.
Figure 29B:
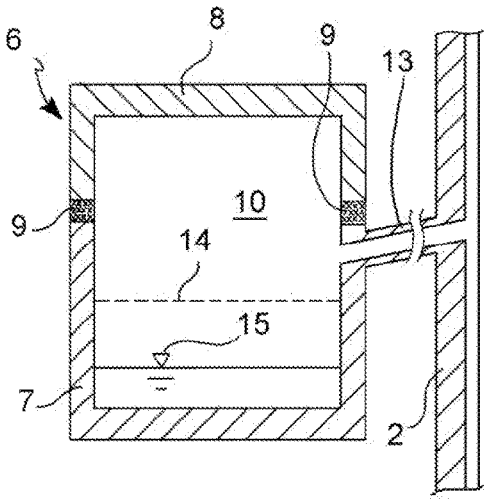
FIG. 29B is a vertical cross-section view of an embodiment of a buffer duct having a vent-to-core venting duct to maintain atmospheric pressure, the vent being connected to the lower duct portion.
Figure 30A:
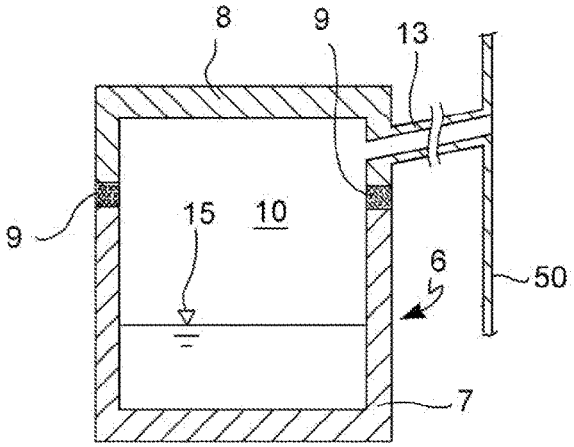
FIG. 30A is a vertical cross-section view of an embodiment of a buffer duct having a vent-to-façade venting duct to maintain atmospheric pressure, the vent being connected to the upper duct portion.
Figure 30B:
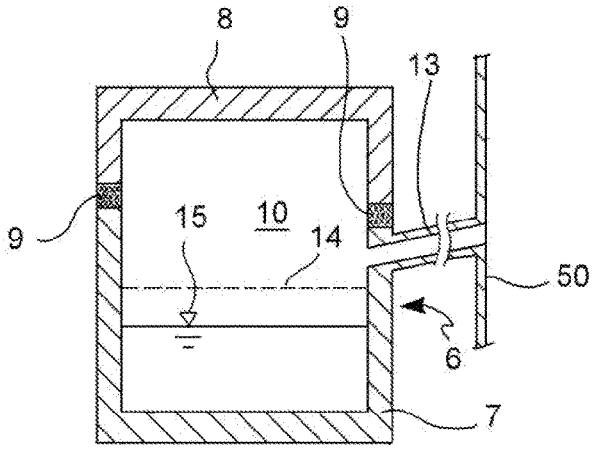
FIG. 30B is a vertical cross-section view of an embodiment of a buffer duct having a vent-to-façade venting duct to maintain atmospheric pressure, the vent being connected to the lower duct portion.

While the atmospheric pressure within the annular transmission chamber 10 can be ensured through (an) air previous interface/s 9 or through an air pressure monitoring and adjustment system, e.g. controlled by the control system 16, for the same purpose one or more venting ducts 13 may be provided, which put the transmission chamber 10 in communication with a venting duct system of the stationary core 2 (FIGS. 29A and 29B) or with ambient air at a façade 50 of the building 4 (FIGS. 30A and 30B). The venting duct system of the core 2 may be its main vent and waste riser. The system 1 may need and comprise shutters and/or pressure compensation means for obviating undesired pressurization and depressurization due to wind direction and velocity.

In case the venting duct 13 is connected to the lower duct portion 7 (FIGS. 29B and 30B), the transmitted liquid upper limit level 14 is below the intersection area between the venting duct 13 and the lower duct portion 7.

It is understood that, when the system 1 comprises two or more interfaces 9, the interfaces 9 may be at different elevations (FIG. 30B), as long as all the interface 9 features hitherto described are maintained.

Although preferred embodiments of the invention have been described in detail, it is not the intention of the applicant to limit the scope of the invention to such particular embodiments, but to cover all modifications and alternative constructions falling within the scope as defined by the claims.

The invention claimed is:

1. System (1) for transmitting liquids between a stationary core (2) and a rotatable story (3) of a building (4) in which said rotatable story (3) is arranged substantially circumferentially around said stationary core (2) and is rotatable with respect to said stationary core (2) about a vertical reference axis (5) that is the longitudinal axis of a section of the core (2) at which the story (3) is arranged, the system (1) comprising one or more annular buffer ducts (6) extending circumferentially around the reference axis (5) of the stationary core (2), each said one or more buffer ducts (6) respectively having an annular lower duct portion (7) extending along the entire circumferential length of the buffer duct (6), and an upper duct portion (8) arranged from above in liquid communication with the lower duct portion (7) and slidingly engaging the lower duct portion (7) in at least one interface (9) extending along the entire circumferential length of the buffer duct (6), one of the lower duct portion (7) and upper duct portion (8) being fixed to the stationary core (2) and the other one of the lower duct portion (7) and upper duct portion (8) being fixed to the rotatable story (3), so that upon rotation of the story (3) with respect to the core (2) about the reference axis (5), the upper and lower duct portions (8, 7) rotate relative to each other about the reference axis (5), each said one or more buffer ducts (6) respectively internally defining at least one annular transmission chamber (10) into which the liquid enters from above through one or more inlet ports (11) formed by the upper duct portion (8), and from which the liquid exits through one or more outlet ports (12) formed by the lower duct portion (7), wherein one of said one or more buffer ducts (6) constitutes a supply duct (25) from the stationary core (2) to the rotatable story (3) and the one or more outlet ports (12) of said supply duct (25) are connected to one or more clean water pressure accumulation tanks (51) with the interposition of one or more clean water pumps (23) for pumping the clean water from the supply duct (25) into the clean water pressure accumulation tanks (51) and for increasing the water pressure in the clean water pressure accumulation tanks (51) to a desired value, wherein said one or more buffer ducts (6) include a clean water buffer duct (6) and a wastewater buffer duct (6), and wherein the transmission chamber (10) is at atmospheric pressure.

2. System (1) according to claim 1, comprising:

transmitted liquid level (15) sensor means for detecting a transmitted liquid level (15) of the liquid in the annular transmission chamber (10) and a controller connected to the transmitted liquid level (15) sensor means and adapted to control one or more inlet valves of the inlet ports (11) in dependency on signals from the transmitted liquid level (15) sensor means.

3. System (1) according to claim 2, wherein the transmitted liquid level (15) sensor means comprise one or more of:

upper level sensors (17) responsive to the transmitted liquid level (15) exceeding a predetermined upper limit level (14), lower level sensors (18) responsive to the transmitted liquid level (15) dropping below a predetermined lower limit level (19), liquid pressure sensors and/or optical sensors and/or electrical resistance sensors, adapted to detect values representative of the transmitted liquid level (15).

4. System (1) according to claim 2, wherein controller is configured in such a way that the transmitted liquid level (15) inside the transmission chamber (10) is maintained always below the at least one interface (9).

5. System (1) according to claim 1, wherein one or more of the clean water pressure accumulation tanks (51) comprise a hydraulic pressure accumulator for stabilizing the water pressure and compensating non constant water usage in the rotatable story (3).

6. System (1) according to claim 1, wherein the at least one interface (9) comprises a dust proof interface seal which closes the one or more interfaces (9) so as to make the respective buffer duct (6) of a substantially closed cross-section.

7. System (1) according to claim 6, wherein the dust proof interface seal comprises a liquid seal (28) having a trough (29) containing a sealing liquid, and a lip or wall or sheet (30) projecting from above into the trough (29) and being immersed in the sealing liquid, wherein the trough (29) forms the lower duct portion (7) face of the interface (9) and the lip or wall or sheet (30) forms the upper duct portion (8) face of the interface (9), or vice versa.

8. System (1) according to claim 7, comprising a drainage system which allows the sealing liquid to flow out of the liquid seal (28), and a replenishing system (38) for feeding sealing liquid into the liquid seal (28).

9. System (1) according to claim 7, wherein discharge of part of the sealing liquid from the liquid seal (28) into the transmission chamber (10) is accomplished by over-replenishment of sealing liquid into the liquid seal (28) trough (29) and overflow of excess sealing liquid above one or more internal overflow wall sections (37) of the trough (29) having a calibrated height which is lower than an external wall of the trough (29).

10. System (1) according to claim 1, wherein at least a portion of a bottom of the annular transmission chamber (10) slopes downwards from one or more locally highest points (32) to one or more locally lowest points (33) where the outlet ports (12) are arranged, thereby driving the flow of liquid towards the outlet ports (12) by means of gravity.

11. System (1) according to claim 10, wherein the clean water buffer duct (6) is positioned at a greater radial distance from the stationary core (2) than the radial distance of the wastewater buffer duct (6) from the stationary core (2), and wherein a clean water supply line to the clean water buffer duct (6) is arranged to extend through the core (2) at the circumferential position of and below a locally highest point (32) of the wastewater transmission chamber (10) bottom.

12. System (1) according to claim 1, wherein the lower portion (7) of the wastewater buffer duct (6) of a given rotatable story (3) and the upper portion (8) of the clean water buffer duct (6) of the rotatable story (3) positioned directly beneath said given rotatable story (3) are formed in a same stationary core (2) wall portion.

13. System (1) according to claim 12, wherein the wastewater buffer duct (6) and the clean water buffer duct (6) are positioned at different radial distances from the stationary core (2).

14. System (1) according to claim 1, comprising a controller to control the one or more clean water pumps (23) in dependency on signals from sensors, wherein the controller also allows manual control interventions.

* * * * *